US011732567B2

(12) United States Patent
Morton

(10) Patent No.: US 11,732,567 B2
(45) Date of Patent: Aug. 22, 2023

(54) APPARATUS AND METHODS FOR HYDROCARBON RECOVERY

(71) Applicant: DRIFT RESOURCES TECHNOLOGIES INC., Okotoks (CA)

(72) Inventor: D. Scott Morton, Okotoks (CA)

(73) Assignee: DRIFT RESOURCE TECHNOLOGIES INC, Okotoks (CA)

( * ) Notice: Subject to any disclaimer, the term of this patent is extended or adjusted under 35 U.S.C. 154(b) by 22 days.

(21) Appl. No.: 17/486,570

(22) Filed: Sep. 27, 2021

(65) Prior Publication Data

US 2022/0098965 A1 Mar. 31, 2022

Related U.S. Application Data

(60) Provisional application No. 63/084,288, filed on Sep. 28, 2020.

(51) Int. Cl.

| | |
|---|---|
| ***E21B 43/29*** | (2006.01) |
| ***E21F 13/04*** | (2006.01) |
| ***E21B 43/16*** | (2006.01) |

(52) U.S. Cl.
CPC ..... *E21B 43/29* (2013.01); *E21B 43/16* (2013.01); *E21F 13/047* (2013.01)

(58) Field of Classification Search
CPC ..... E21B 10/60; E21B 43/29; E21B 43/305; E21B 17/22; E21B 17/20; E21B 4/02; E21C 41/24
See application file for complete search history.

(56) References Cited

U.S. PATENT DOCUMENTS

2008/0122286 A1* 5/2008 Brock ..... E21B 41/0064 299/4

FOREIGN PATENT DOCUMENTS

CA 2623698 C * 5/2012 ..... E21B 7/002
CA 2614569 C * 7/2012 ..... E21B 41/0064

OTHER PUBLICATIONS

Translation of CN 109488270. (Year: 2019).*

* cited by examiner

*Primary Examiner* — Zakiya W Bates
(74) *Attorney, Agent, or Firm* — Holzer Patel Drennan

(57) ABSTRACT

Apparatus and methodologies of mining hydrocarbons from a target area within a subterranean formation, wherein a first phase involves providing at least one production well having at least one mechanical excavator rotatably disposed therein and rotating the mechanical excavator to convey the mined hydrocarbons from the formation to the surface, and a second phase involves, as the hydrocarbons being mined are depleted, withdrawing the mechanical excavator away from the formation, such that additional hydrocarbons are mined.

19 Claims, 23 Drawing Sheets

APPARATUS AND METHODS FOR HYDROCARBON RECOVERY

CROSS REFERENCE TO RELATED APPLICATIONS

The present application claims the benefit of priority to U.S. Patent Application No. 63/084,288 filed Sep. 28, 2020, which is specifically incorporated by reference herein for all that it discloses or teaches.

FIELD

Embodiments herein are generally related to apparatus and methodologies for recovering hydrocarbon-containing materials, such as oil sands and the like. More specifically, apparatus and methodologies of recovering oil sand deposits in the middle zone are provided.

BACKGROUND

Increasing demand for the decreasing supply of conventional oil has led to a search for additional sources of hydrocarbon and to the continued development of more efficient methods of recovery. Canada currently has 10% of the world's proven oil reserves, with 98% being oil sands. To date, oil sands have primarily been recovered using surface mining, particularly where the oil sands layers occur at relatively shallow depths (e.g., between 0-50 meters in depth). Large power shovels and trucks are used to recover the oil sands, which are then transported to processing facilities for separation of the hydrocarbon (bitumen) component from the sand and water components.

It is well known, however, that oil sands deposits commonly dip deeper into the ground than can be efficiently and economically recovered with surface mining techniques. Surface mining also requires large land areas to be stripped of overburden, which must then be transported away from the site and stored until reclamation can be performed. Costs of stripping overburden and ongoing land reclamation quickly render convention surface mining processes uneconomical, particularly for deeper oil sands deposits. As a result, surface mining of oil sands deposits is commonly limited to shallower reserves or only those areas that are profitable to mine, leaving significant portions of the oil sands untouched. Indeed, the Athabasca Oil Sands comprises a total area of about 142,000 $km^2$, but only about 3% of the area or approximately 4,800 $km^2$ is currently surface minable.

Where oil sands are not recoverable by surface mining, in-situ thermal recovery methods may be used, including steam injection (e.g., cyclic steam stimulation, "CSS"), solvent flooding, gas injection, etc., with the most commonly used technique being Steam Assisted Gravity Drainage ("SAGD"). Generally, thermal recovery methods use heat to reduce the viscosity of the bitumen in the oil sands so that it can be mobilized, resulting in such techniques being capable of targeting deeper subterranean deposits (i.e., approximately 200 meter or more in depth, presuming adequate caprock is present). However, required caprock integrity, water demand, surface heave, and carbon dioxide emissions from steam generation have all emerged as challenges for thermally enhanced oil production. As a result, SAGD and other in situ methods have been applied with varying degrees of success, both in terms of total recovery factor and economics, resulting in large areas of the oil sands again being unrecovered and available for extraction.

There remains a need for the development of oil sand recovery techniques capable of targeting unrecovered deposits, particularly when the oil sands are too deep for economical surface mining and conventional in-situ thermal recovery methods cannot be used.

Unfortunately, research into underground extractive mining processes, such as mining for access and hydraulic mining, have been investigated as far back as the 1980s with minimal success. For example, mining for access operations, which require underground shafts, tunnels, and/or rooms to be excavated, have been plagued with environmental and safety issues caused by the release of underground gases and ground subsidence, rendering such methods unviable. Hydraulic mining operations, which involve applying hot water into the deposit to mobilize the oil sands into a slurry that can be pumped to surface, still often require personnel underground, and involve complicated, timely procedures to backfill the mined cavity. For example, U.S. Pat. No. 8,313,152 describes a hydraulic mining process where high-pressure fluids are injected into the deposit to fluidize the oil sands into a slurry for recovery at a production well. As mining of the deposit continues, recovered slurry or tailings is re-injected back into the cavity in a complicated and timely 'staged' manner, leading to an expensive series of mining and backfilling sequences. Moreover, hydraulic mining methods require complex injector heads having a multiplicity of fluid nozzles through which fluid can be ejected into the formation at high pressure, as well as suction nozzles through which the fluidized sand or slurry can be removed.

To date, known underground mining operations are not cost effective and still suffer from significant environmental and safety concerns. Known underground mining operations continue to highlight common issues in the mining industry, such as surface/deposit access, product lifting difficulties, and reliability of downhole equipment. Attempts to mine hydrocarbons via vertical boreholes failed to successfully overcome ground subsidence issues. Early methods also failed to account for the presence of gases dissolved in the bitumen, a significant safety hazard to underground mining and the stability of access points or tunnels. As such, many existing underground mining operations have been discontinued for economic, safety, and environmental issues.

There remains a need for the development of oil sands recovery techniques capable of targeting unrecovered deposits, such techniques providing a cost-effective process that improves upon safety and environmental concerns of the prior art. For example, there is a need for an improved method of recovering oil sands from unrecovered deposits, particularly between depths ranging from approximately 50 meters to 200 meters in depth (i.e., a zone referred to as 'the middle'.

SUMMARY

According to embodiments, apparatus and methodologies of recovering hydrocarbons from a target area within a subterranean formation are provided, the apparatus and methodologies comprising providing at least one production well in the formation at or near the target area, providing at least one mechanical excavator rotatably disposed within the production well, the mechanical excavator having a first input end and a second discharge end, permitting the hydrocarbons at the target area to be received within the first input end of the mechanical excavator, and rotating the at least one mechanical excavator to convey the recovered hydrocarbons from the first input end to the second discharge end for recovery. In some embodiments, as the hydrocarbons being recovered at the target area are depleted, the present apparatus and methodologies may further comprise withdrawing the at least one mechanical excavator away from the target area for permitting additional hydrocarbons to be received within the first input end of the mechanical excavator.

In some embodiments, the present apparatus and methodologies may further comprise providing at least one injection well for injecting pressurized fluids into an injection area in the formation. The at least one injection well may be positioned for the injection area to be offset from the target area. The at least one injection well may be positioned at a sufficient distance from the at least one production well to form a formation barrier therebetween, and/or to form at least one formation pillar therebetween.

In some embodiments, as the hydrocarbons being recovered at the target area are depleted, the present apparatus and methodologies may comprise forming at least one void adjacent the at least one pillar. In some embodiments, the present apparatus and methodologies may further comprise injecting the pressurized fluids via the at least one injection well into the at least one void. It is contemplated that the injection of the pressurized fluids may be continuous or intermittent with the recovery of hydrocarbons.

In some embodiments, the present apparatus and methodologies are used to recover hydrocarbons from a target area between approximately 50 meters and 200 meters below the surface, wherein the recovery of hydrocarbons may be by the mechanical excavator and may be gravity-driven.

A detailed description of exemplary embodiments of the present apparatus and methodologies is provided herein. The present apparatus and methodologies are not to be construed as limited to these embodiments as the exemplary embodiments aim only to provide a particular application of the technology. It will be clear to those skilled in the art that the present apparatus and methodologies have applicability beyond the exemplary embodiments set forth herein.

DETAILED DESCRIPTION OF THE PREFERRED EMBODIMENTS

According to embodiments, apparatus and methodologies of use are provided for the improved recovery of hydrocarbons from a subterranean formation, including from a previously inaccessible or unexploited area of the formation. The present apparatus and methodologies may be used to target areas in the formation that are relatively difficult or impossible to excavate using conventional recovery methods, such as oil sands deposits that are too deep for surface mining or inaccessible by in situ thermal recovery (i.e., where no caprock exists, or other environmental limitations are present). Herein, the term hydrocarbon may refer to any hydrogen-carbon-containing organic materials generally and, more specifically, to bitumen extracted from oil sands.

In some embodiments, the present apparatus and methodologies may be used to safely and economically mine hydrocarbons, such as oil sands (e.g., less than 20° API), located in an area or zone of the formation referred to as the "middle". Without limitation, the middle may be an area estimated to be as shallow as approximately 50 meters (~165 ft) and as deep as approximately 200 meters (~650 ft) or more below the surface.

Figure 1:
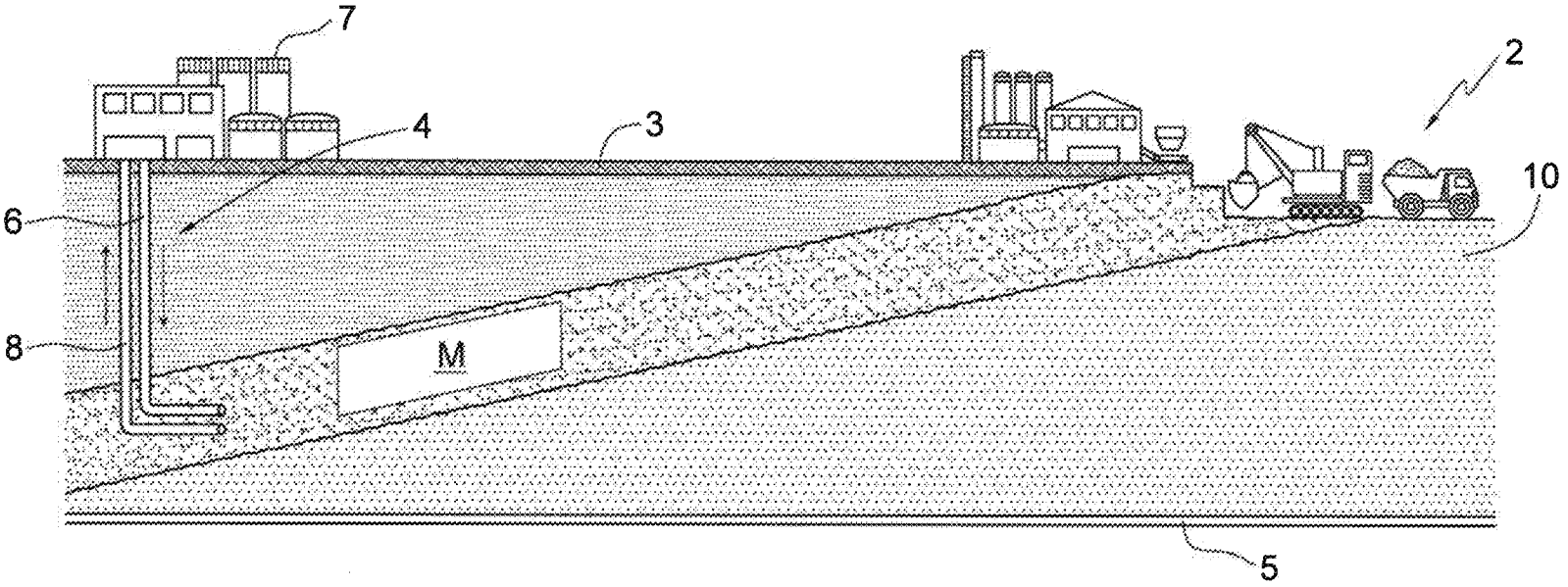
FIG. 1 (PRIOR ART)
FIG. 1 is a schematic diagram depicting an approximation of a hydrocarbon-containing subterranean formation targeted by the present apparatus and methodologies, according to embodiments.

By way of explanation, FIG. 1 (PRIOR ART) provides a side elevation, cross sectional schematic depicting some principles of the present apparatus and methodologies. In one aspect, a conventional open-pit surface mining operation 2 is shown using large shovels to remove the overburden and oil sands located at or near the surface. In another aspect, a conventional in situ thermal recovery operation 4 is shown using at least one injection well 6 to inject heated fluid deep into the formation to heat and mobilize the bitumen for production by at least one corresponding production well 8. In each case, the bitumen produced may be transported to at least one oil sands processing facility 7, such as a bitumen extraction plant. As depicted schematically for explanation purposes, neither the surface mining operation 2 nor the in situ operation 4 are operative to target oil sands from an area substantially in the middle 'M' of the formation.

It is contemplated that the present apparatus and methodologies may be used to target hydrocarbons found deeper within oil sands deposits, while overcoming many of the limitations of conventional operations. Indeed, the present apparatus and methodologies may be used without disrupting the overburden or requiring an open-pit mine, without requiring adequate caprock integrity, without the need for large amounts of energy to generate steam, without personnel being positioned downhole, and/or other safety and environmental concerns.

Although an area of the formation is defined herein as the 'middle', such definition is for explanatory purposes only and it should be appreciated that any area of a subterranean formation containing hydrocarbons may be targeted using the present apparatus and methodologies. Without limitation, although the present apparatus and methodologies are described for use in accessing previously unexploited oil sands deposits, including deposits located in the 'middle', the present technologies may be used for the recovery of hydrocarbons from any subterranean formation, as appropriate.

The present apparatus and methodologies will now be described in more detail having regard to FIGS. 1-9.

According to embodiments, apparatus and methodologies of use for recovering hydrocarbons from a target area of a subterranean formation are provided, including providing at least one production well into the formation at or near the target area, providing at least one mechanical excavator rotatably disposed within the production well, the mechanical excavator having a first input end and a second discharge end, permitting the hydrocarbons at the target area to be received within the first input end of the mechanical excavator, and rotating the at least one mechanical excavator to convey the recovered hydrocarbons from the first input end to the second discharge end for recovery at the surface. As will be described, the present apparatus and methodologies may comprise providing at least one mechanical excavator, such as an auger or other applicable helical shaft (helical drive vane) tool, for gravity-driven excavation of the oil sands from the deposit and for the conveyance of the recovered oil sands to the surface.

According to embodiments, as mining continues, the present apparatus and methodologies may also comprise withdrawing the at least one mechanical excavator away from the target recovery area (i.e., uphole towards the surface) such that, as mining continues, the hydrocarbons are continuously or near-continuously received by the excavator. That is, as mining continues and the hydrocarbons are depleted, the at least one mechanical excavator may be controllably pulled-back from the initial target excavation location so that the hydrocarbons within the deposit continuously or nearly-continuously collapse into the target area being mined, filling any void as it appears at the excavator. In this manner, the present apparatus and methodologies enable gravity-driven recovery of the hydrocarbons until the resource is exhausted. Herein, reference to the terms "above/uphole" and "below/downhole" are used for explanatory purposes and are generally intended to mean the relative uphole and downhole direction from surface.

According to embodiments, the present apparatus and methodologies may also comprise providing at least one means for injecting a pressurized fluid into the formation, the pressurized fluid serving to create a pressure gradient, offset and at a distance away from the target area, to support the gravity-driven mining of the hydrocarbons. In this regard, injection of pressurized fluids into the formation may provide a pressurized support for the hydrocarbons (e.g., at a distance from the oil sands being mined) to ensure that the hydrocarbons collapse from the formation away from the support and into the at least one excavator, without mixing or being contaminated by the injected fluids. Injection of pressurized fluids may or may not occur simultaneously with the mechanical gravity-driven excavation of the oil sands, and the fluids may be injected continuously or intermittently, as desired. Advantageously, the injection of pressurized fluids into the formation may also serve to manage any risk of ground subsidence, to address tailings management issues, and to mitigate greenhouse gas emissions.

Figure 2:
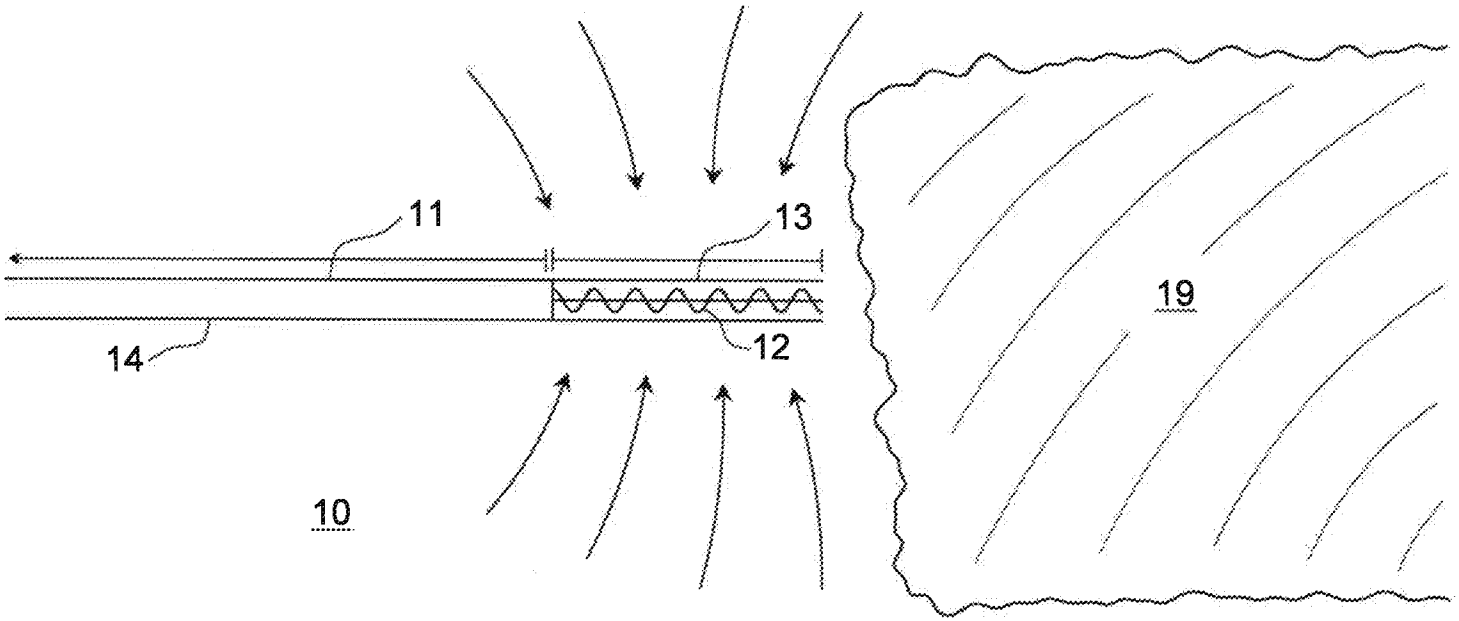
FIG. 2 is schematic diagram depicting a top-down plan view of the present apparatus and methodologies comprising at least one mechanical excavator disposed within a borehole, according to embodiments.

Having regard to FIG. 2, a top-down schematic shows the present apparatus and methodologies disposed within a hydrocarbon-containing subterranean formation 10, such as an oil sands deposit. The formation may be overlain by an overburden layer 3 and can overlie a basement zone 5 (see FIG. 3A). The subterranean formation 10 may be defined as a generally horizontal area of hydrocarbons, and specifically oil sands, to be extracted and may be located at or near a depth from surface defined as the middle of the formation (i.e., at or near a depth of between 50-200 meters from surface).

In some embodiments, the present apparatus and methodologies may comprise disposing at least one mechanical excavator 12 positioned within at least one borehole, operative as a production well 14, drilled into the formation 10. In some embodiments, the present methods comprise drilling a production well into the formation until it extends into the target excavation area. For example, where desired, production well 14 may be directionally drilled from a surface pad through the overburden and into the formation 10 using existing directional drilling technology conventionally used in the oil and gas industry. Efficient guidance of the drilling operation may require commonly used tools in the oil and gas industry including, without limitation, steering tools, survey tools such as measurement-while-drilling 'MWD' tools, and the like. In other embodiments, the production well 14 may be a pre-existing production well or a branch therefrom, where excavator 12 may be retro-fitted into one or more previously installed well pairs. Herein, production well and/or production well 14 may be used interchangeably to refer to any well drilled into the formation 10 and used for the recovery hydrocarbons therefrom.

Figure 3A:
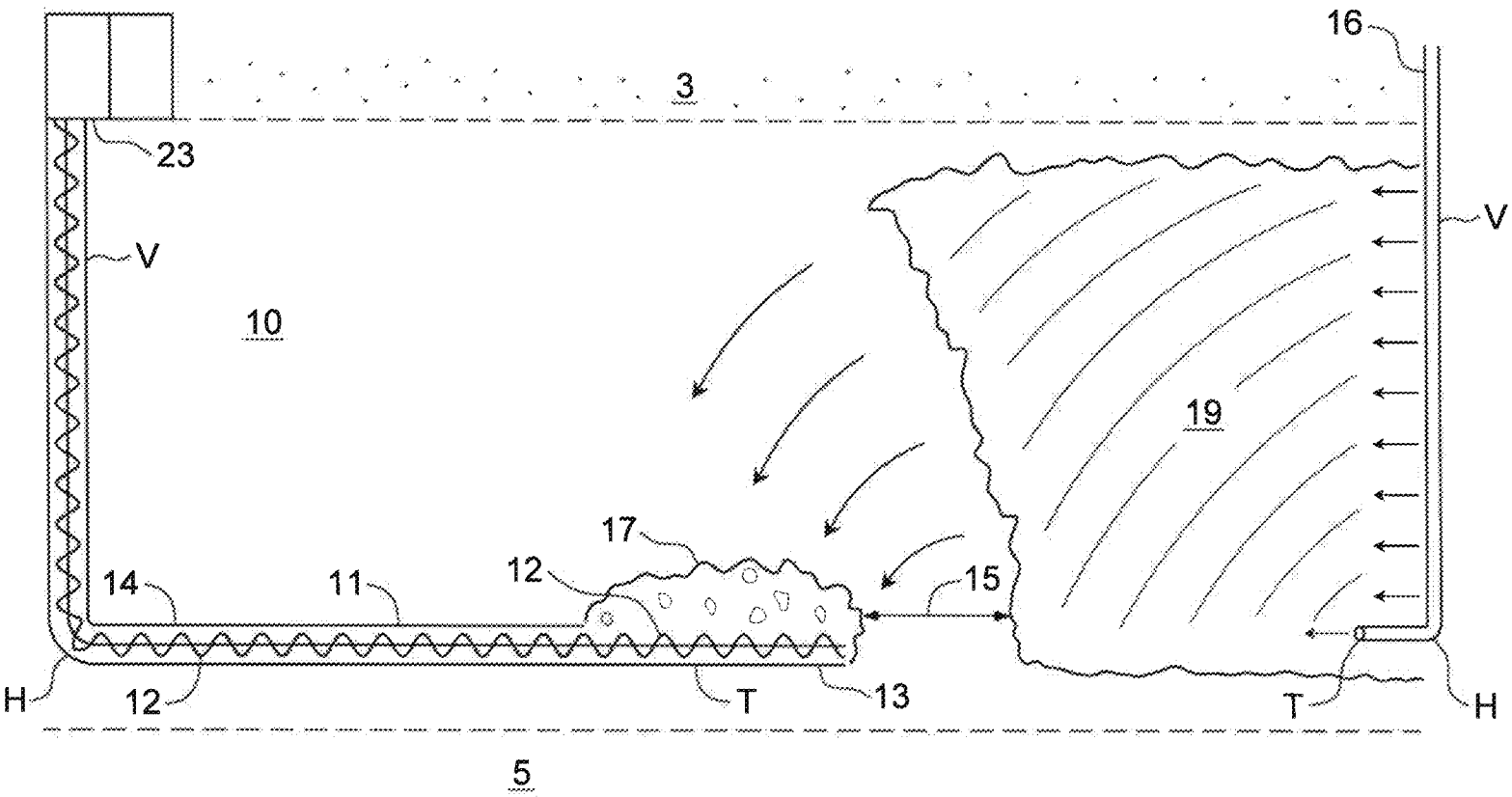
FIGS. 3A-3F are schematic diagrams depicting a sequence of a stage a first and second phase of the present apparatus and methodologies, according to embodiments.

In some embodiments, having regard to FIG. 3A, production well 14 may comprise a substantially horizontal or deviated section, having toe 'T' and heel 'H' sections, and a substantially vertical section 'V'. Production well 14 may be sized and shaped to cause the collapse of the hydrocarbons from the formation 10 into the well 14. Production well 14 may comprise an open hole, or may comprise at least one casing string, liner, or the like. In some embodiments, production well 14 may comprise a casing string having a full diameter 11, or production well 14 may comprise a casing profiled at or near the toe T section to form a 'halfmoon' or 'crescent' shape 13, such profiling being configured to provide a larger opening or input end at toe T end of the production well 14. In some embodiments, at least a portion of production well 14 may have a casing string having a full diameter 11, and at least another portion of production well 14 may have a profiled casing diameter 13.

As will be described, it is contemplated that production well 14 may be positioned in operational proximity to at least one corresponding injection well 16, the injection well 16 serving primarily to inject pressurized fluids into the formation 10 as needed.

Having regard to FIGS. 3A-3F, the present apparatus and methodologies will be described with reference to two general phases of operation, generally, where the first (mining) and second (mining and injection) phases may be performed in sequence and/or simultaneously, as desired.

Figure 3B:
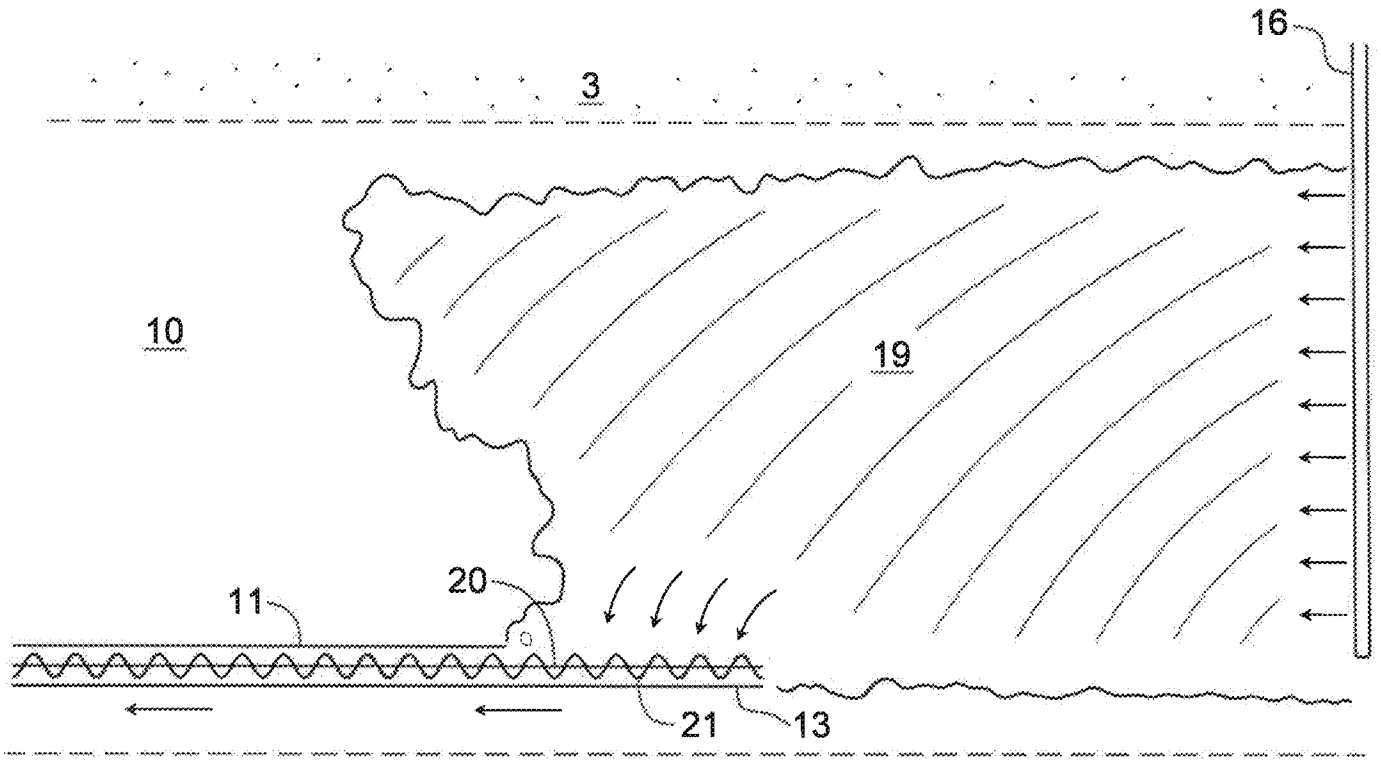
Figure 3C:
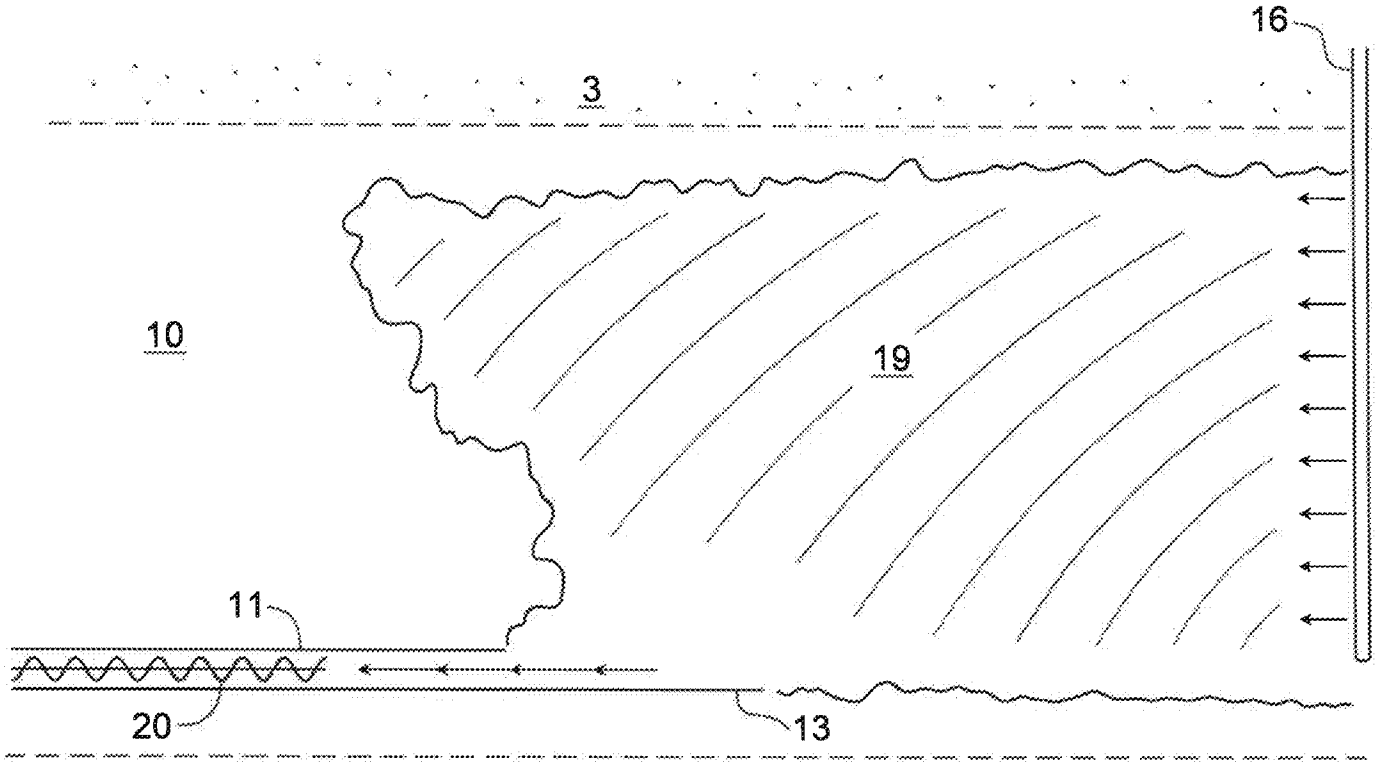

A first phase of the present apparatus and methodologies is shown schematically in FIGS. 3A and 3C, the first phase being a mining phase comprising the use of at least one mechanical excavator 12 to mine, via gravity, a target area 17 of a hydrocarbon-containing subterranean formation 10 (see arrows depicting gravitational movement of formation 10, FIG. 3A). As mining continues and the target area 17 becomes depleted of hydrocarbons, the first phase may also comprise withdrawing or pulling excavator 12 uphole away from the depleted target area 17 into a new target area or zone of the formation 10 where additional hydrocarbons may be recovered (see arrows depicting withdrawal of excavator 12, auger 20, FIG. 3C). Withdrawal of the excavator 12 may also include withdrawal of the casing/liner and may occur gradually at predetermined times and rates with or without ceasing production of the hydrocarbons.

Figure 3D:
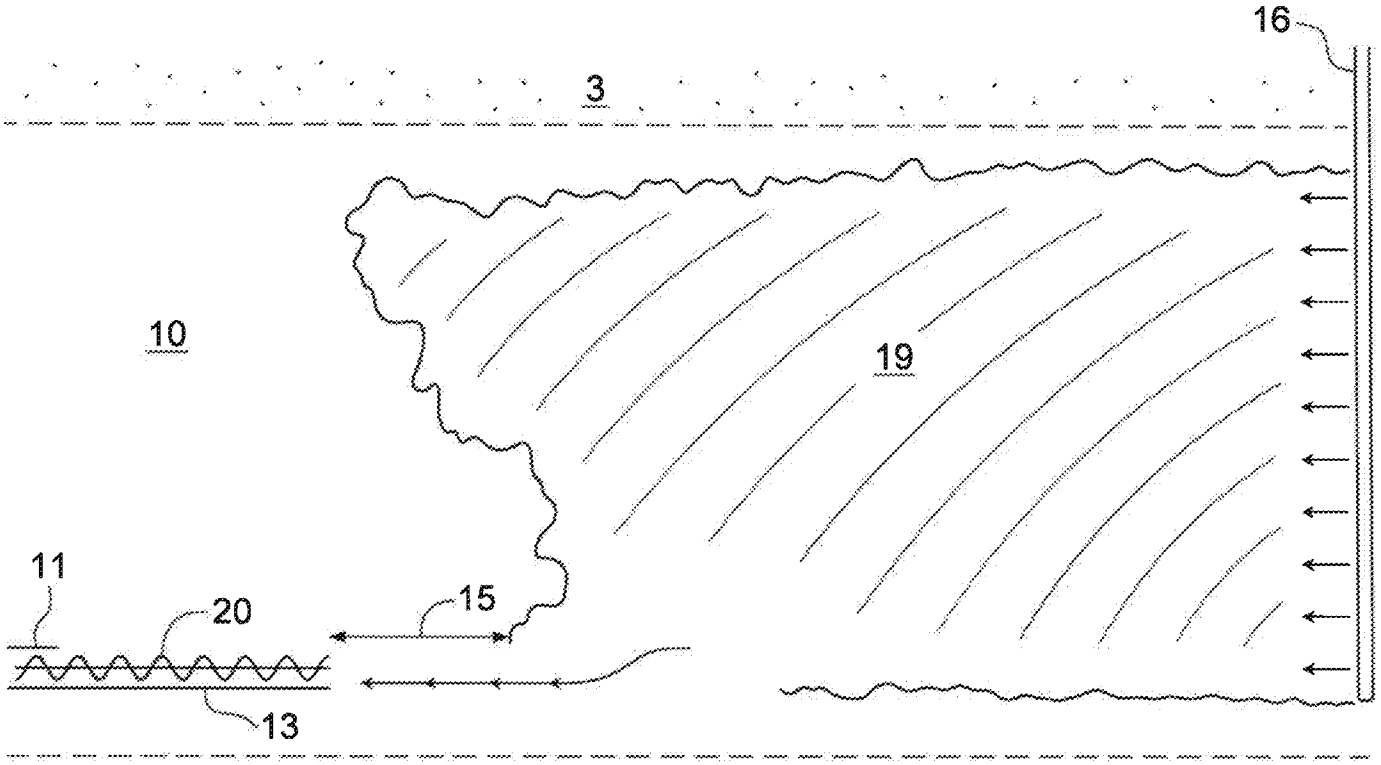

A second phase of the present apparatus and methodologies is shown schematically in FIGS. 3B and 3D, the second phase being an injection phase comprising the use of at least one injection well 16 to inject pressurized fluids into an injection area 19 located at a distance from the target area 17 (see arrows from injection well 16, FIG. 3B). The pressurized fluids serve to provide pressurized support to the formation 10 being mined, i.e., to ensure that hydrocarbons being mined fall towards and into the target area 17 for recovery by excavator 12 (interchangeably referred to herein as auger 20, as outlined below). Where the target area 17 becomes depleted (as above) and/or becomes contaminated with injected fluids (as measured and detected at surface, as shown in FIG. 3B), the at least one mechanical excavator 12 may be withdrawn away from the depleted target area 17 and pulled back (uphole) into an unrecovered zone of the formation 10 (as shown in FIG. 3D). The first and second phases will now be described in more detail.

FIGS. 3A-3F show a cross-sectional schematic sequence of one embodiment of the present apparatus and methodologies. FIG. 3A shows a substantially horizontal section of production well 14 positioned within the hydrocarbon-containing formation 10, a toe T end of the production well 14 landing at or near a target hydrocarbon recovery area 17. Where desired, i.e., when a second phase of the present apparatus and methodologies is used, at least one injection well 16 may also be positioned within the hydrocarbon-containing formation 10, a toe T end of the injection well 16 landing at or near an injection area 19, said injection area 19 being offset from or landing at a distance away target recovery area 17 (e.g., see formation barrier 15).

More specifically, in some embodiments, wells 14,16 may be positioned within formation 10 such that at least a sufficient portion of the formation 10 remains in place in between the wells 14,16, that is—an adequate formation barrier 15 separates target area 17 from injection area 19. In this manner, formation barrier 15 formed between wells 14,16 may prohibit contamination of hydrocarbons being recovered from target area 17 by fluids being injected into injection area 19.

As above, wells 14,16 may be drilled so as to land at or near the bottom of the formation 10, at an area determined to be approximately the middle M of the formation 10, or as otherwise appropriate (e.g., as determined by a drilling operator). For example, wells 14,16 may be configured to penetrate the formation 10 such that, during operation, the hydrocarbons being excavated collapse, via gravity, lack of cohesion and/or an internal angle of friction, from the formation 10 into the at least one production well 14 for conveyance to the surface. In some embodiments, such as for overly thick layers of oil sands, more than one well 14,16 or well pair may be provided at any time during operation (not shown). Each one or more additional injection and production wells 14,16 may be similar in size and configuration to the well pairs described herein. As above, one or more casing strings and/or liners may be run inhole, as would be known in the industry.

Once at least one production well 14 and at least one injection well 16 are completed, a first phase of the present operations may be initiated whereby at least one mechanical excavator 12, may be extended into production well 14. In some embodiments, the at least one mechanical excavator 12 may extend until it reaches the profiled opening 13 of casing. In this manner, at least a portion of excavator 12 may extend beyond the full casing 11 and be operative to receive hydrocarbons falling via gravity from the target area 17. Hydrocarbons collapsing from the formation 10 into well 14 are received by the mechanical excavator 12, transported along well 14, and then conveyed uphole for recovery at the surface.

More specifically, in some embodiments, one example of mechanical excavator 12 may comprise at least one rotatable auger conveyor 20, the auger 20 being operably connected to and powered by a drive motor, e.g., a direct drive motor, and/or gear box positioned at surface (not shown). The motor may be a hydraulic, pneumatic, or electrically powered motor, and may drive the gearbox (or other transmission mechanism). At least one processor may be provided for controlling and adjusting the rotational rate of each at least one auger 20, as desired. For instance, auger motor may include a programmable drive which monitors amperage and rpms of each at least one auger 20, individually and/or collectively, and may thus be tied to a master computer (not shown). As will be described, the at least one processor and/or master computer may further provide for the controlled withdrawal of auger 20 from production well 14. It should be appreciated that the size and capacity of the at least one auger 20 may be determined, as desired, and may comprise any other componentry needed for the operation thereof, including lubrication componentry, and the like.

Having regard to FIG. 3B, auger 20 may comprise an input end 21 and an output end 23, for receiving and discharging materials into and out from the auger 20, respectively. As above, auger 20 may be rotatable about its longitudinal axis within well 14. In some embodiments, auger 20 may comprise a plurality of or a continuous helical vane serving as a conveyor for recovered materials, i.e., to convey materials substantially horizontally from the toe T to the heel H, and substantially vertically from the heel H to the surface.

In some embodiments, a string of one or more auger lengths connected end to end may be provided (not shown), each length cooperating with the next adjacent length such that, in effect, the augers 20 form a continuous train within well 14 along which the material being excavated may be conveyed from the formation 10 directly to the surface. The number, size, and configuration of the at least one auger 20 may vary depending upon the volume and rate of materials being recovered. Thus, during a first phase, hydrocarbons mined from the formation 10 are primarily received into input end 21 of auger 20 via gravitational means and, as auger 20 is rotated about its longitudinal axis, are transported uphole to the discharge end 23 at surface. Mining may continue until the resource in the first target area 17 is depleted.

As above, as production of hydrocarbons in the target area 17 become depleted, the at least one auger 20 alone or in combination with any well casing/liner may be pulled-back (i.e., withdrawn uphole, FIG. 3C), thus moving auger 20 away from the now-depleted target area 17 to access additional hydrocarbons within the formation 10 (e.g., FIG. 3D).

Figure 4A:
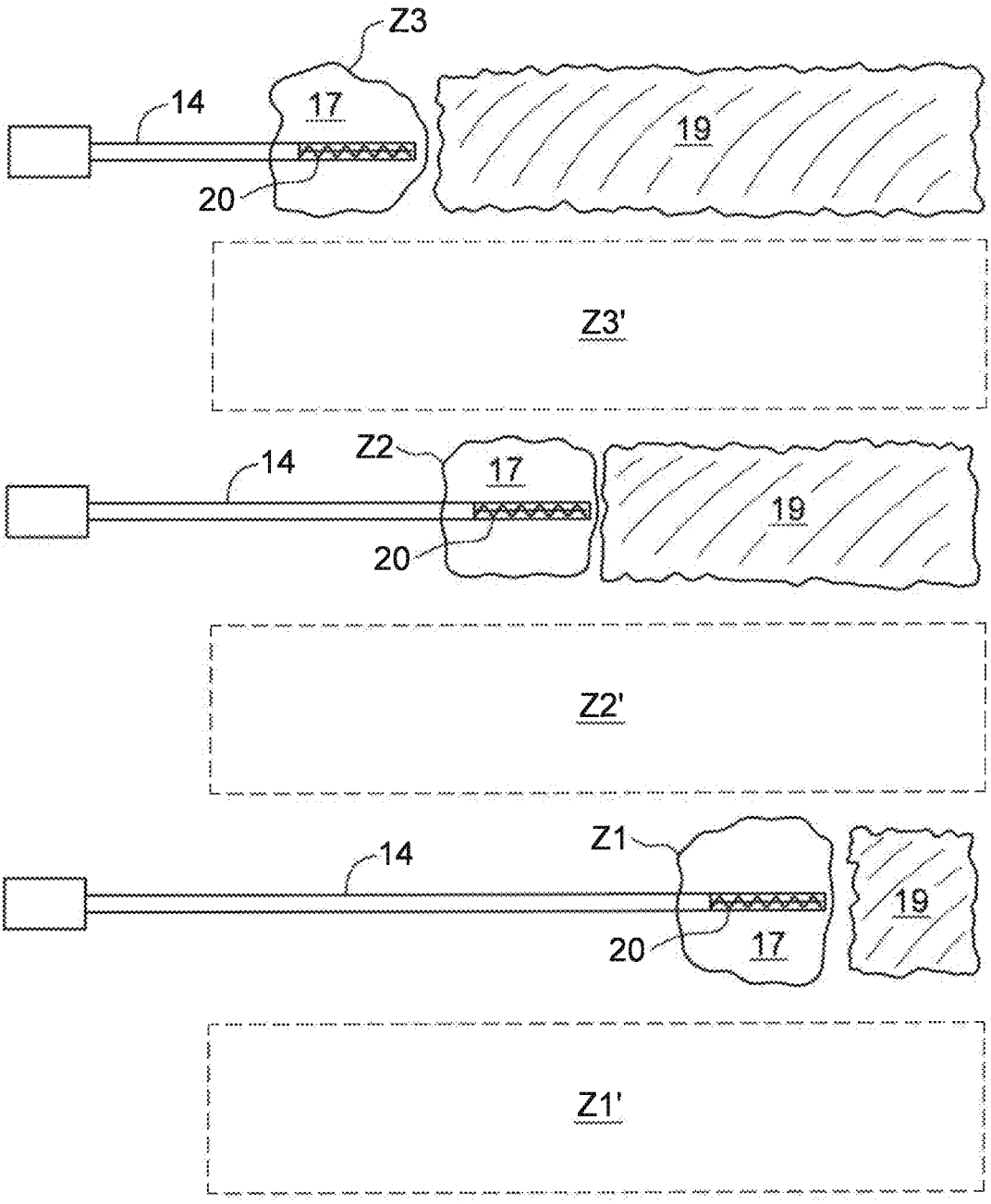
FIGS. 4A and 4B are a schematic sequence of possible stages of the first and second phases of the present apparatus and methodologies shown in FIGS. 3A-3F, according to embodiments.
Figure 4B:
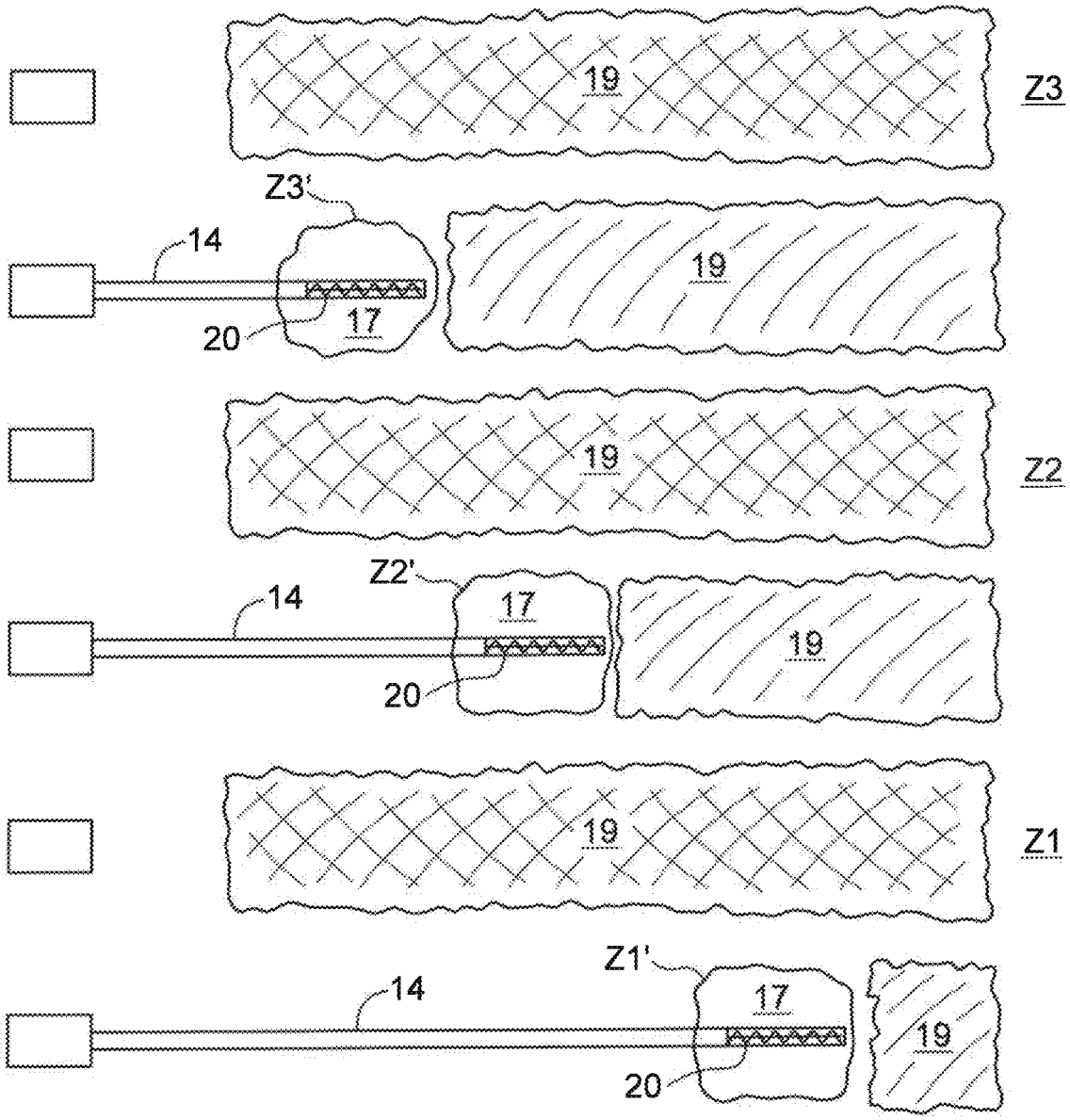
Figure 5A:
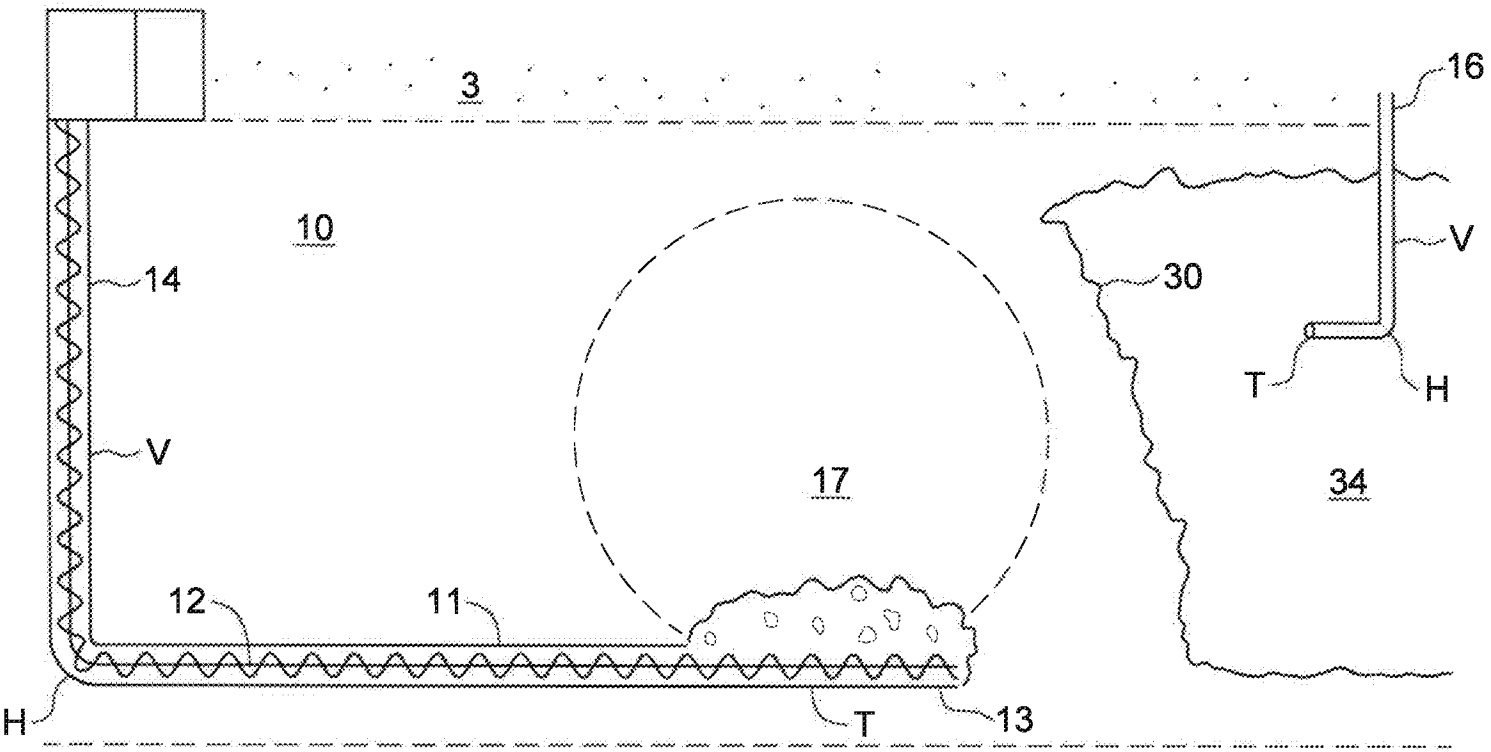
FIGS. 5A-5G are schematic diagrams depicting a sequence of a stage of a first and second phase of the present apparatus and methodologies, according to alternative embodiments.
Figure 5B:
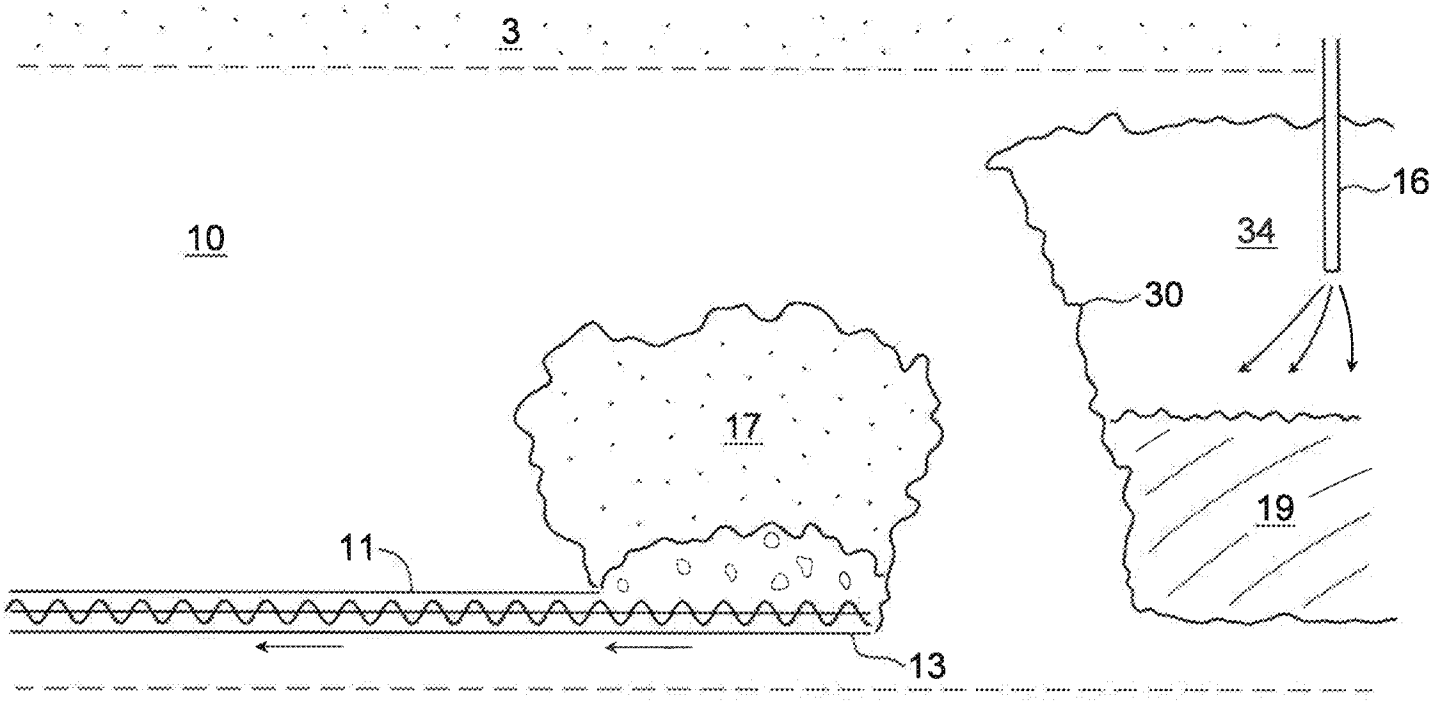
Figure 5C:
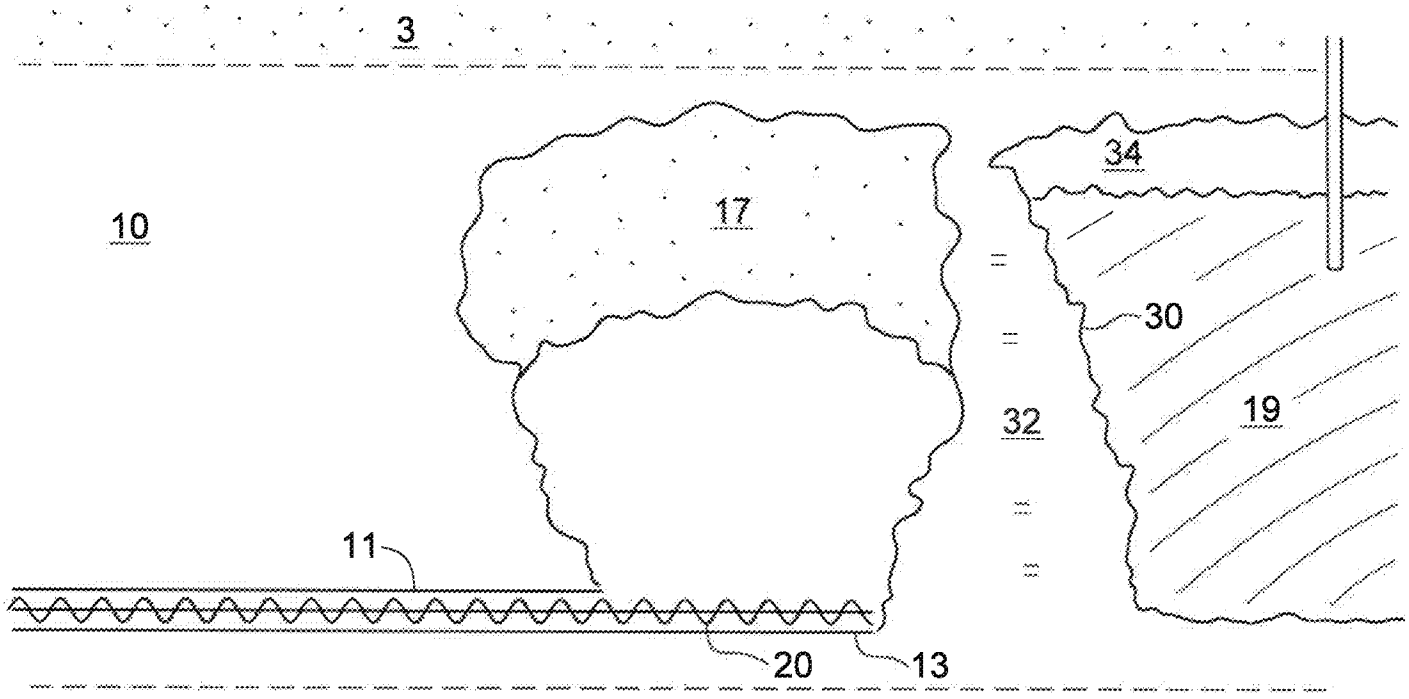
Figure 5D:
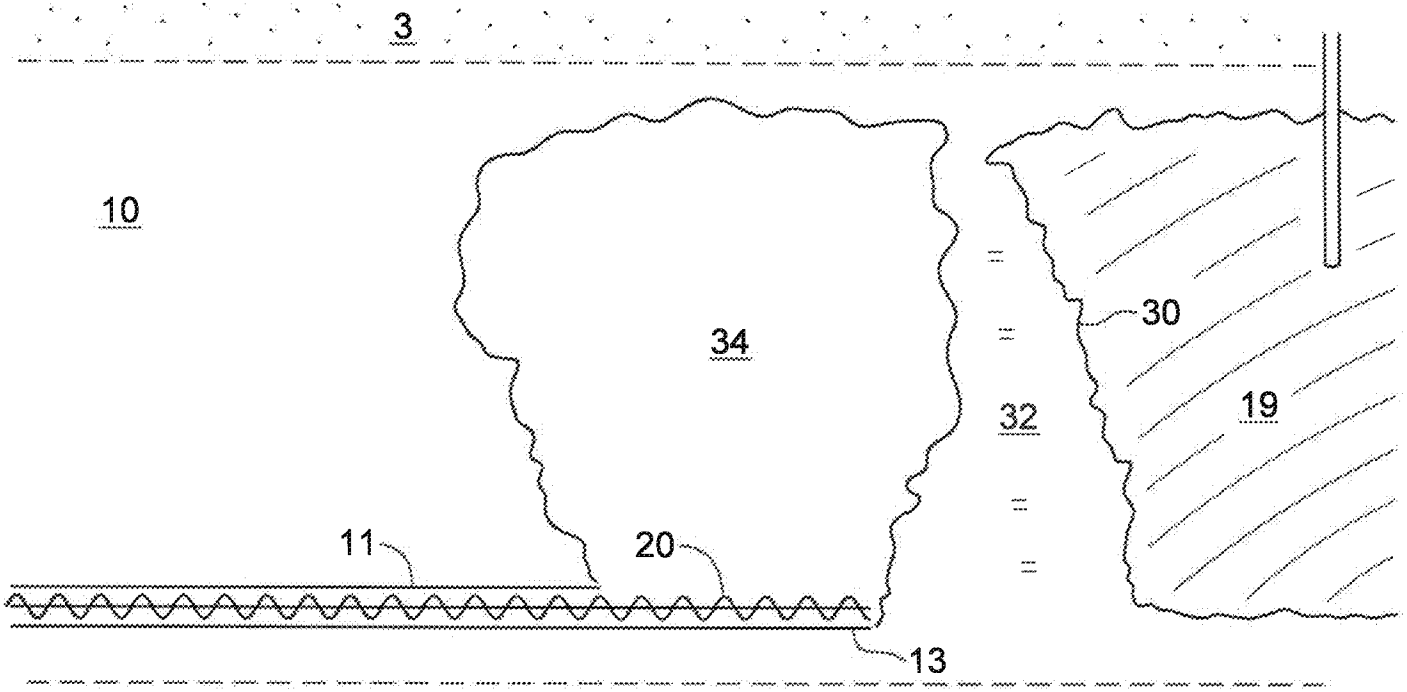
Figure 5E:
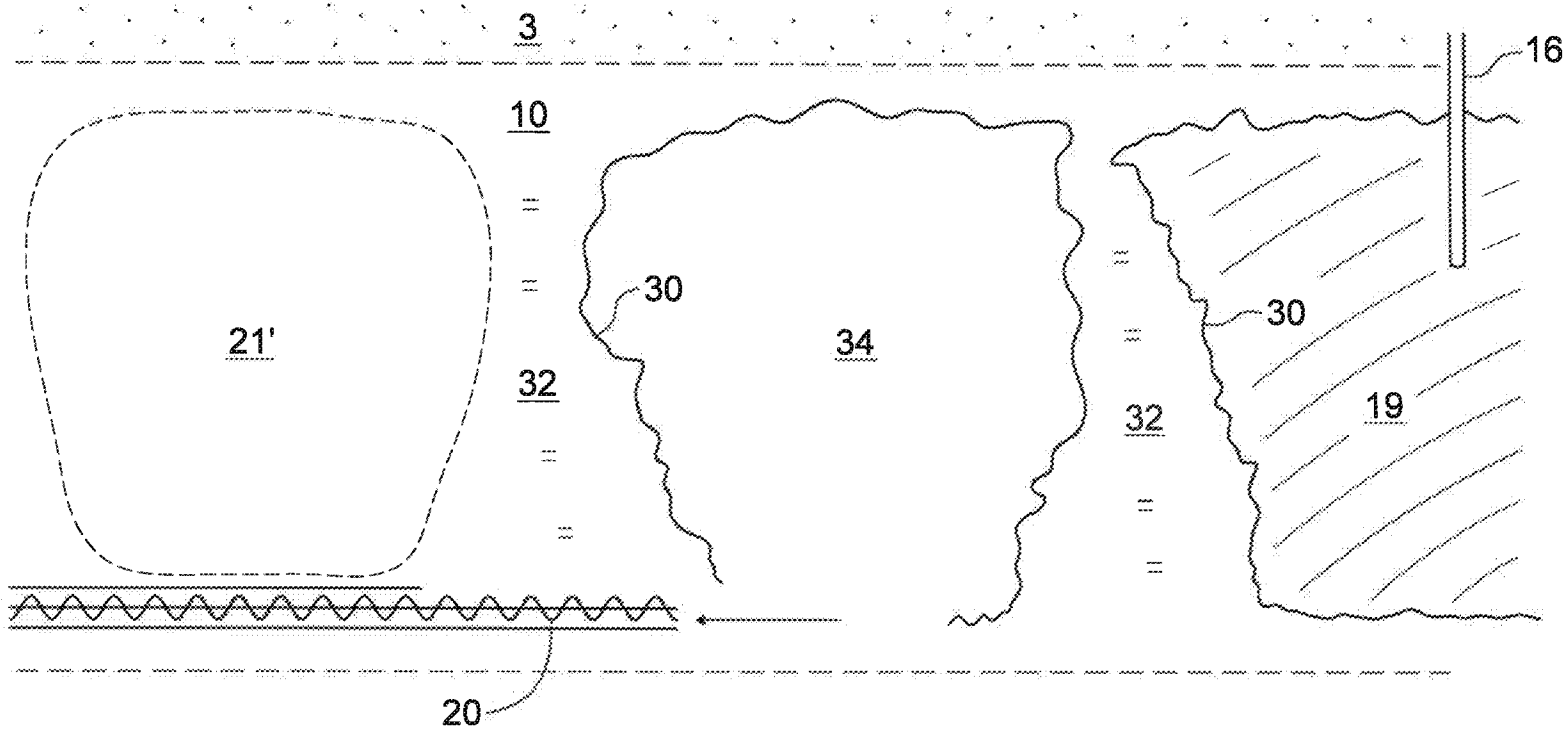
Figure 5F:
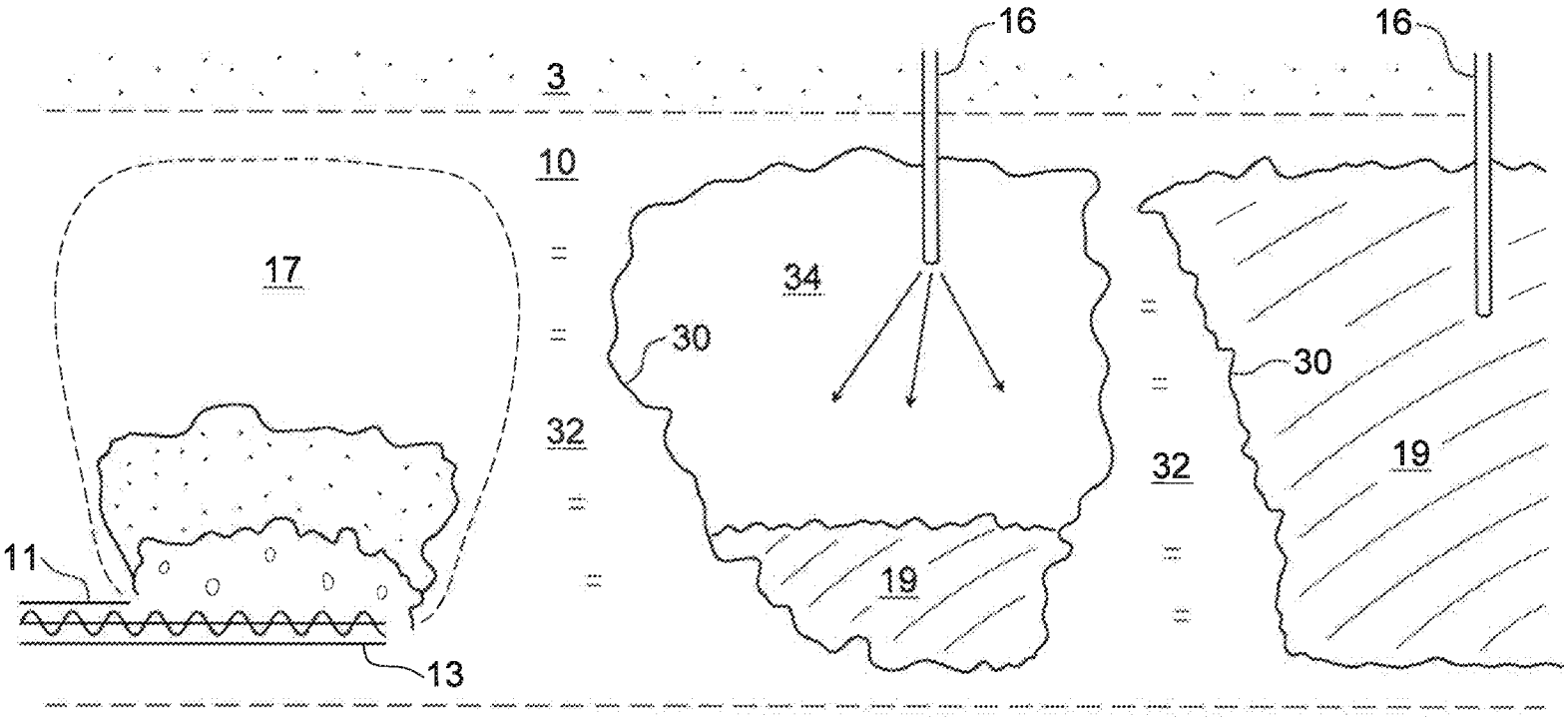
Figure 5G:
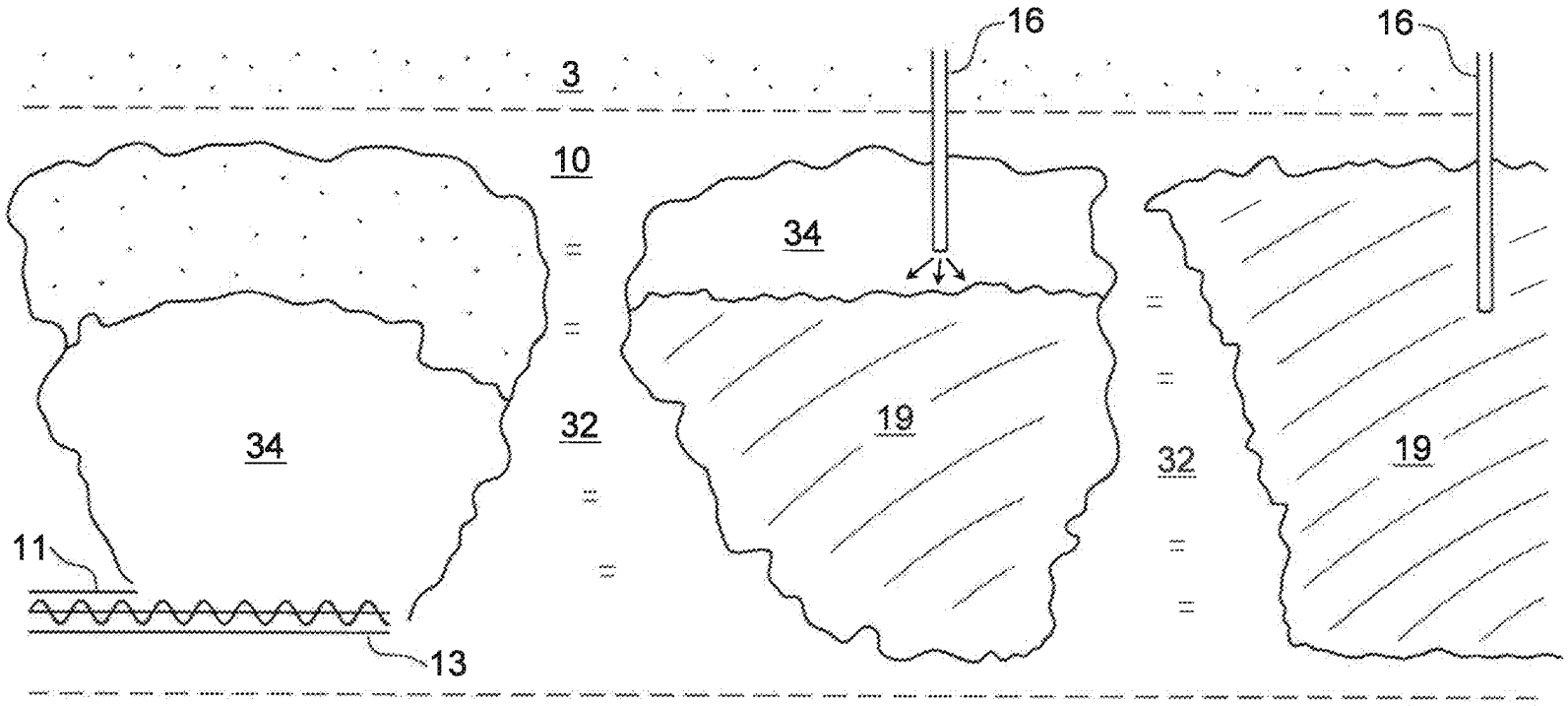

For example, having regard to FIGS. 4A and 4B, as the auger 20 mines the target area 17 in a first recovery zone Z1 and the hydrocarbons are depleted, auger 20 may be withdrawn (pulled uphole) away from the first recovery zone Z1 until it reaches a second recovery zone Z2, where it is measured and detected that additional hydrocarbons can be recovered. Phase one mining of second zone Z2 continues until the hydrocarbons are again depleted. At this time, auger 20 may again be withdrawn (pulled uphole) away from the second recovery zone Z2 until it reaches a third recovery zone Z3, and so on until the formation 10 is exhausted. As would be appreciated, the presently described apparatus and methodologies may be performed in selected target zones Z1, Z2, Z3, . . . Zn adjacent to one another and/or separated by one or more future target zones Z1', Z2', Z3', . . . Zn'.

Movement of the at least one auger 20 may occur at predetermined and controlled times and rates, as desired, to maximize the gravitational production of the resource. Where it is determined that the first phase of the presently described operations is complete, a second phase of the operations may be commenced. As above, although the first and second phases are described herein as separate processes occurring in sequence for explanatory purposes, it should be understood that said phases may occur simultaneously, intermittently, or as otherwise determined by an operator.

As desired, a second phase of the presently described operations may be use in order to enhance or support the gravity-driven mining of hydrocarbons described in the first phase. In this second phase, it is contemplated that as the gravity mining described in the first phase continues, the production of hydrocarbons can be enhanced or 'tuned' by creating and maintaining a pressure gradient within the formation 10. According to embodiments, the pressure gradient during the second phase may be controllably sustained in such a manner so as to support the gravitational mining of the formation 10.

More specifically, in some embodiments, having further regard to FIGS. 3A-3F, a second phase of the present apparatus and methodologies may comprise injecting, via the at least one injection well 16, pressurized fluids into the formation 10. Herein, pressurized fluids may comprise tailings slurry, the tailings primarily comprising sand in the case of oil sands. Injection of pressurized fluids may occur over time and at predetermined rates. Advantageously, injection of pressurized fluids may be controlled in order to correspond with the withdrawal of the at least one excavator 12, thereby pressure-supporting the gravitation mining of the hydrocarbons and optimizing recovery thereof. In this manner, production of the formation 10 remains gravity driven but, over time and at predetermined rates, may be supported by the creation of a pressure gradient to maintain the hydrocarbon front and prevent the hydrocarbons from gravitationally falling 'backwards' or away from the target area 17 being mined.

As above, the at least one injection well 16 may be positioned at a distance from the at least one production well 14. In some embodiments, the present apparatus and methodologies may comprise drilling an injection well 16 into the formation 10 until it extends into the formation 10 at an injection area 19 offset from the target recovery area 17, creating a formation barrier 15 therebetween, but near enough to operationally correspond with production well 14.

For example, having regard to FIG. 3A, injection well 16 may be directionally drilled from a surface pad through the overburden and into the formation 10 using existing directional drilling technology conventionally used in the oil and gas industry. Efficient guidance of the drilling operation may require commonly used tools in the oil and gas industry including, without limitation, steering tools, survey tools such as measurement-while-drilling 'MWD' tools, and the like. In other embodiments, the injection well 16 may be a pre-existing production well or a branch therefrom, e.g., it may comprise an injection well from one or more previously installed well pairs used in the oil and gas industry.

In some embodiments, injection well 16 may comprise a substantially horizontal or deviated section, having toe 'T' and heel 'H' sections, and a substantially vertical section 'V'. Injection well 16 may be configured for the injection of pressurized fluids and/or fill into the formation 10, as desired. In some embodiments, injection well 16 may be perforated or substantially perforated along its length, and/or may be configured with one or more jets or nozzles to enhance injection.

Having regard to FIGS. 3A and 3D, it should be appreciated that injected fluids are not injected into or near the target recovery area 17. Injected fluids are not injected as a means of backfilling the excavated area 17. Instead, injected fluids are injected behind formation barrier 15, the fluids serving to provide a pressurized 'wall' or 'edge' 30 within the formation 10 to prohibit fluids from contaminating hydrocarbons being recovered from the target area 17 (see FIG. 3E). Support edge 30 generated by the injection of fluids into the injection area 19 prevents hydrocarbons in the formation from falling away from the target area 17 and instead causes oil sands within the formation 10 to fall, via gravity, towards the target recovery area 17.

Figure 3E:
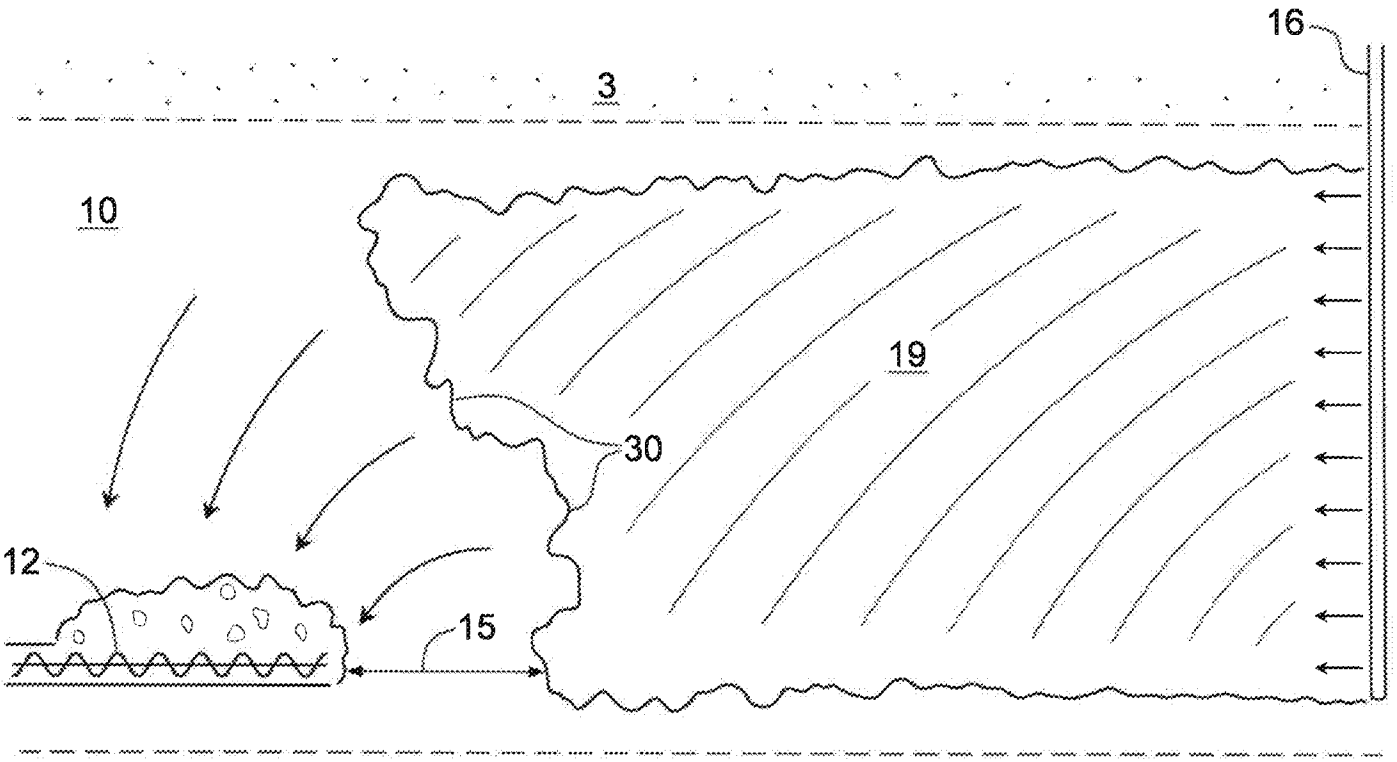
Figure 3F:
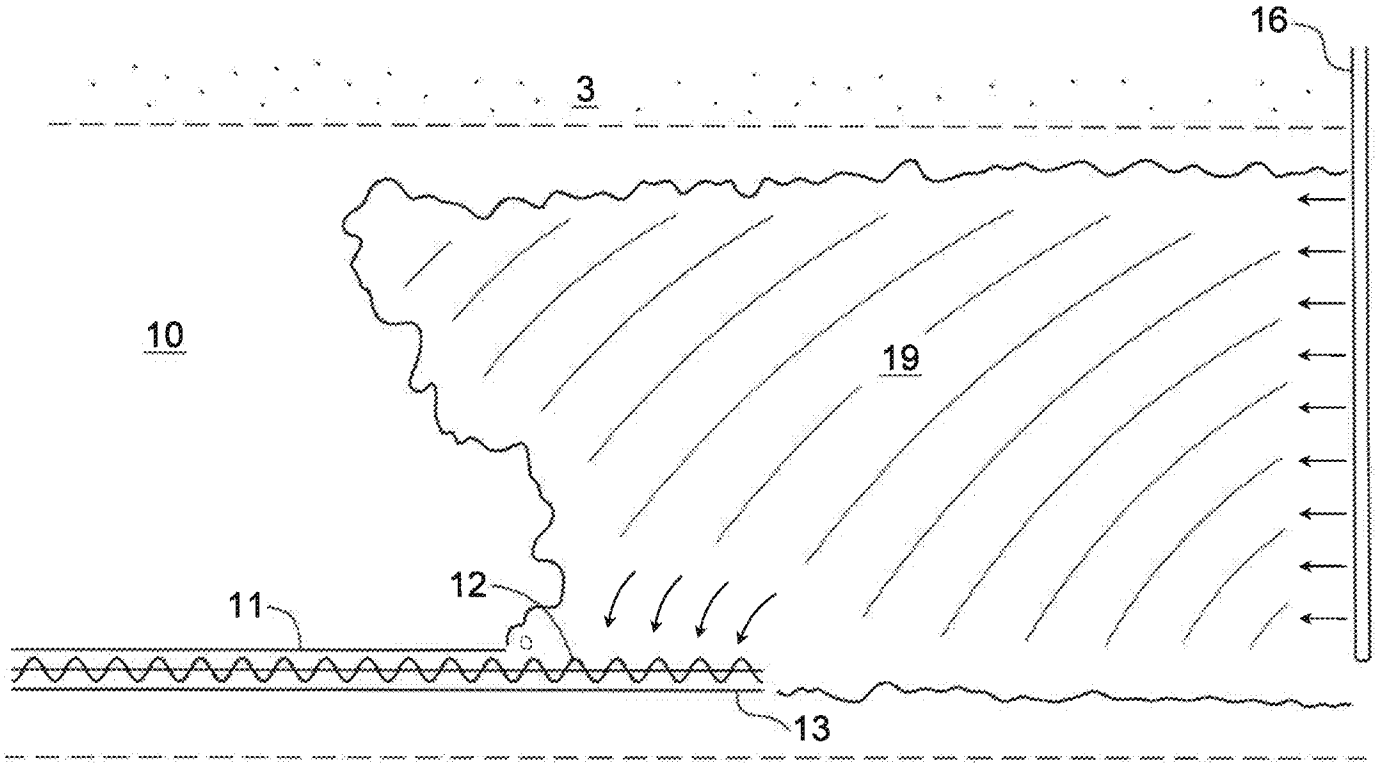

Where, however, it is determined that at least a portion of the hydrocarbons being recovered from target area 17 have become mixed with pressurized fluids, injection of fluids may be ceased and auger 20 and casing/line may be withdrawn, respectively, from the depleted target area (as described above). For example, having regard to FIGS. 3B-3D, where it is determined that formation barrier 15 has been diminished (FIGS. 3B, 3F), injection may be ceased and auger 20 and casing/liner may be withdrawn (FIGS. 3C, 3D) until another formation barrier 15 is reconstituted and mining can be reinitiated (FIGS. 3D, 3E). It is contemplated that the present apparatus and methodologies may be performed, where desired, without ceasing, pausing, or otherwise interrupting either the excavation of the hydrocarbons and/or the injection of the pressurized fluids.

Having regard to FIGS. 5A-5G, it may be determined that formation barrier 15 is failing to prevent injected fluids from contaminating the hydrocarbons being recovered. For example, according to alternative embodiments of the present apparatus and methodologies, where it is determined that injected fluids are detected too soon or too often in hydrocarbons being recovered, and excavator 12 and casing are being pulled back earlier than deemed optimal, some embodiments of the present apparatus and methodologies may warrant that formation barrier 15 be configured to form a more stable formation pillar 32 positioned adjacent at least one void 34, said void 34 then becoming the injection area 19, as will be described.

For example, where it is determined that formation barrier 15 has been diminished, target recovery area 17 may be mined until hydrocarbon recovery from the area is depleted and a void 34 is formed in the formation 10 (FIG. 5A-5D). At this time, auger 20 and casing/liner may be withdrawn (FIG. 5E) until at least one formation pillar 32 (e.g., approximately 50 meters across) is formed. Mining of a new target area 17 may then commence and injection of pressurized fluids be initiated to fill the at least one void 34 (e.g., FIGS. 5B-5C). In this manner, having regard to FIGS. 5G and 5F, the creation and filling of at least one void 34, separated by at least one formation pillar 32, provides additional assurances that the target mining area 17 is not contaminated with fluids being injected into the formation 10. As above, it is contemplated that the present apparatus and methodologies may be performed, where desired, without ceasing, pausing, or otherwise interrupting either the excavation of the hydrocarbons and/or the injection of the pressurized fluids.

Figure 6A:
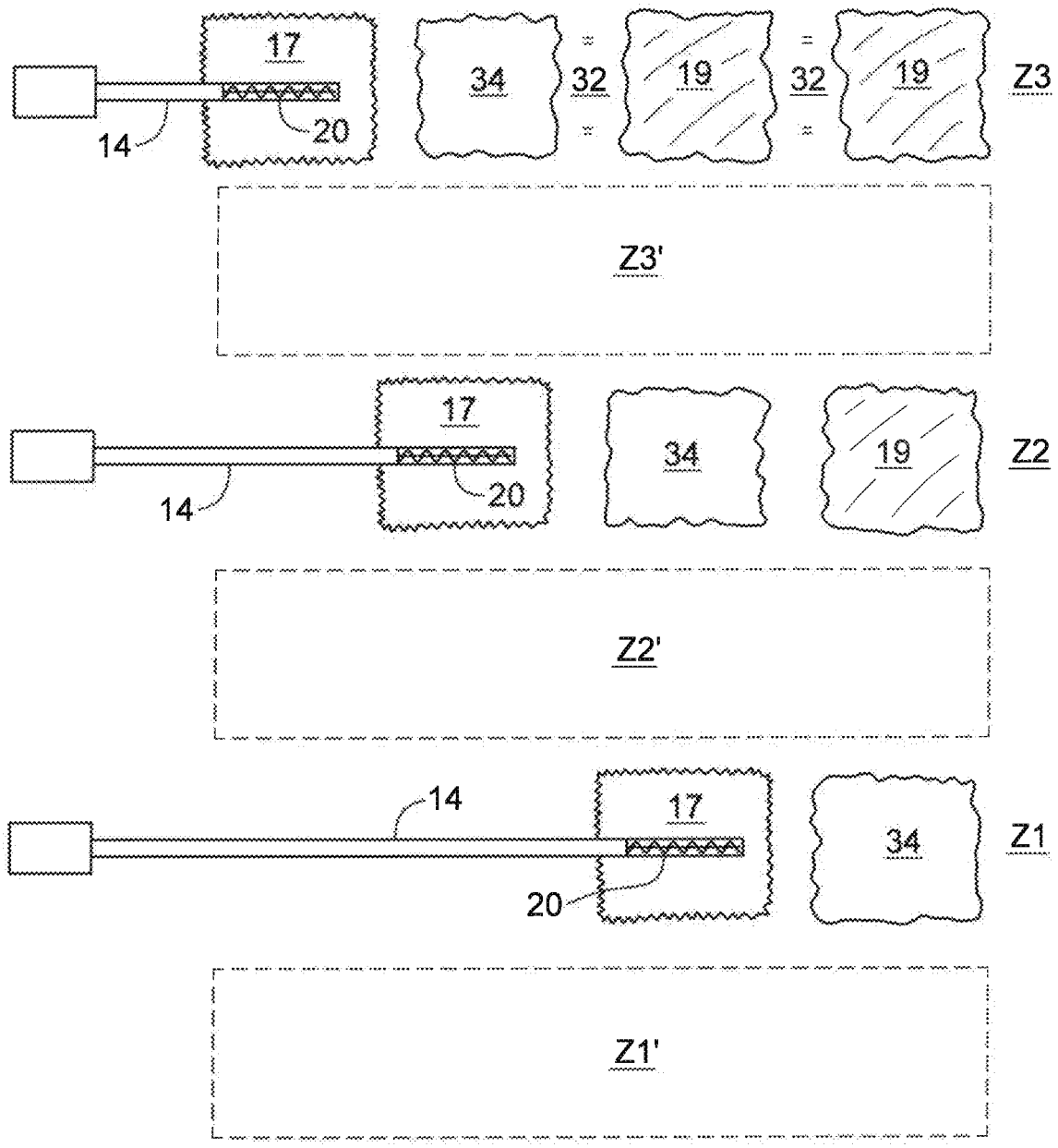
FIGS. 6A and 6B are a schematic sequence of possible stages of the first and second phases of the present apparatus and methodologies shown in FIGS. 5A-5G, according to embodiments.
Figure 6B:
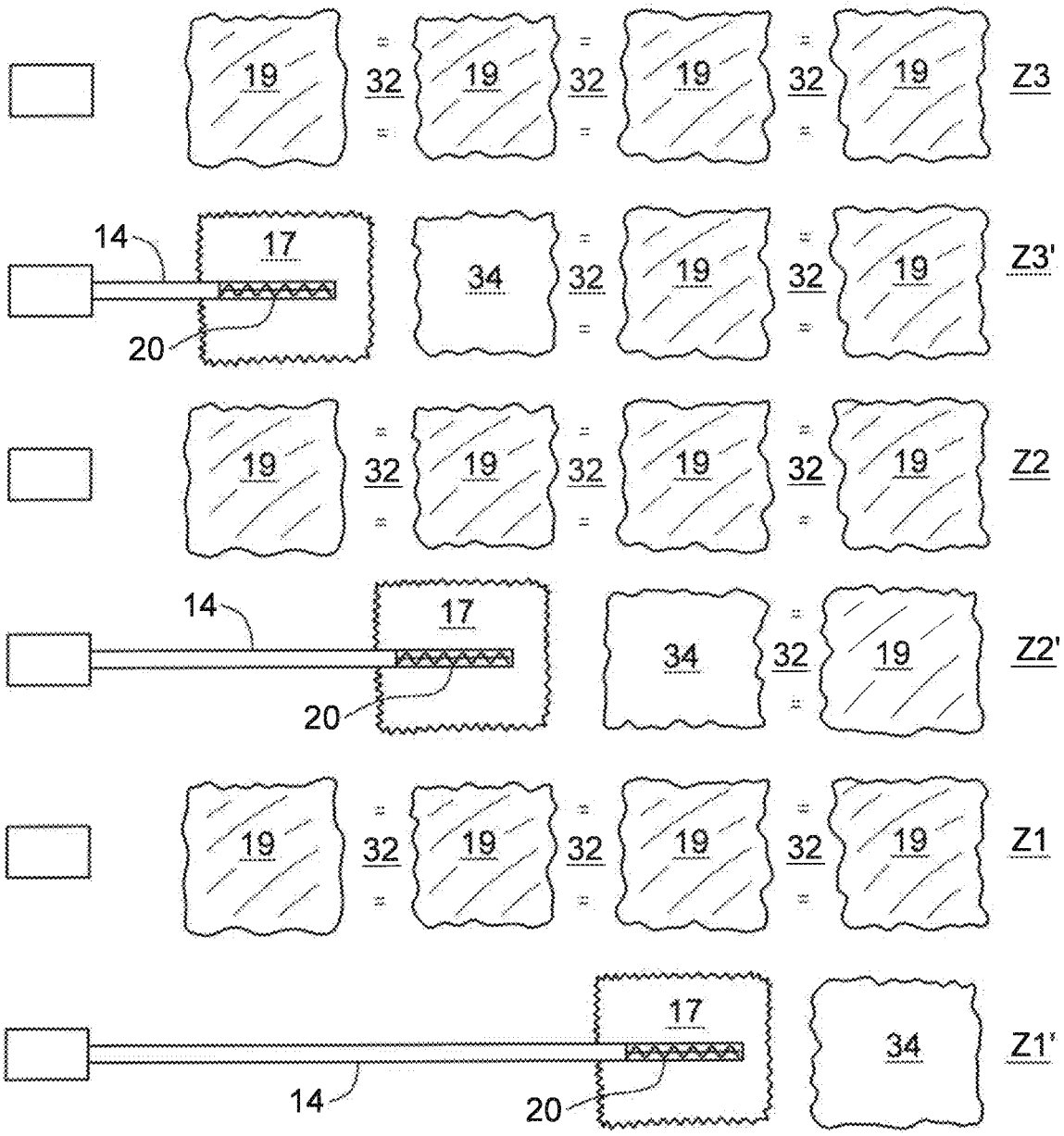

Having regard to FIGS. 6A and 6B, it follows that as auger 20 mines a target area 17 in a first recovery zone Z1 and the hydrocarbons are depleted, auger 20 and casing/liner may be withdrawn (pulled uphole) away from the first recovery zone Z1 until it reaches a second recovery zone Z2, where it is measured and detected that additional hydrocarbons can be recovered. Withdrawal of auger 20 and casing/liner may be to such a distance from first zone Z1 that a sufficient formation pillar 32 between first zone Z1 and the next target area 17 is formed. First zone 1 may remain a void 34 until such time as injection fluids can be fed, via injection well 16, into the injection area 19, thereby filling the void 34.

As above, phase one mining of second zone Z2 continues until the hydrocarbons are again depleted. At this time, auger 20 and casing/line may again be withdrawn (pulled uphole) away from the second recovery zone Z2, leaving a void 34, until it reaches a third recovery zone Z3, and so on until the formation 10 is exhausted and each void 34 is filled. As would be appreciated, the presently described apparatus and methodologies may be performed in selected target zones Z1, Z2, Z3, . . . Zn adjacent to one another and/or separated by one or more future target zones Z1', Z2', Z3', . . . Zn'.

It should be appreciated that the pressurized fluids injected via the at least one injection well 16 may comprise any appropriate fluids known in the art. In some embodiments, the fluids may comprise tailings from oil sands processing operations, including oil sands materials produced during the first phase of the presently described methods. Although tailings are described herein as a preferred embodiment of pressurized fluids injected via the at least one injection well 16, any material having acceptable density and strength characteristics to achieve the desired result may be used.

It should be appreciated that the volume of hydrocarbons recovered via gravity-driven mining at the first and second stages may vary depending on local ground conditions, formation pressure, formation gases and production capacity. In some embodiments, mining may be carried out more or less continuously with the injection of pressurized fluids being carried out while mining is in progress. Alternately, mining and fluid injection may be carried out at different times and may be intermittent.

Hydrocarbons recovered by the present apparatus and methodologies may be processed at surface via known oil separation methods, such as bitumen extraction methods. For example, once a volume of hydrocarbons is mined, they may be transported directly to the processing facility on site for treatment using a conventional hot water process.

Figure 7:
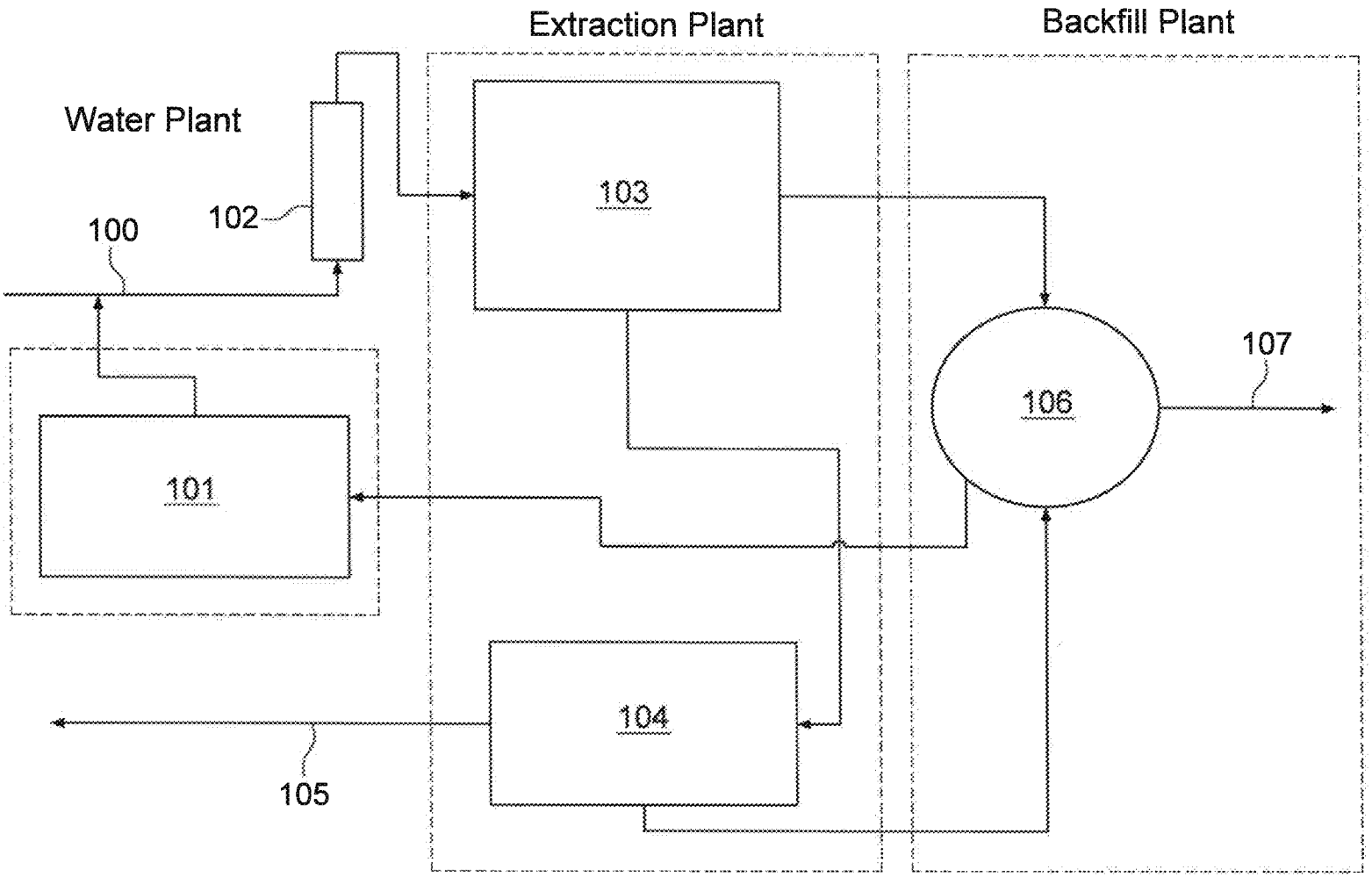
FIG. 7 is a schematic flowchart depicting a hydrocarbon processing operation, according to embodiments.

Having regard to FIG. 7, a schematic illustrating a sequence of oil sands processing is provided, according to embodiments. For example, oil sands produced by the present operations may initially be mixed with hot water 100 from a water plant 101, the water being sourced from a well, a river, or a storage facility. The hot water and oil sands mixture may then be fed through a crusher or sizer 102 to break down any large chunks, before being transported to an extraction plant 103 for mechanical hot water separation. Bitumen and water produced during separation are fed to a flotation tank 104 where, via known methods in the oil and gas industry, a bitumen froth product is generated for commercial sale 105 (e.g., said product comprising a water-in-bitumen emulsion of approximately 55-60 wt % bitumen, 30-45 wt % water, and 2-10 wt % solids). A middlings stream, comprising water and sand (e.g., approximately 85 wt % solids and approximately 15 wt % water), produced during the separation are treated with a thickener 106 to settle out suspended solids and return clear water back to the water plant 101, and to produce a paste fill which is transported to the injection well 107 for injection into the formation 10 via injection well 16. As would be appreciated, water from the flotation tank 104 may be used during the thickening process 106.

Although a conventional hot water process is described for the separation of bitumen from the presently excavated oil sands, it should be appreciated that any appropriate process or treatment may be used including, without limitation, a diluent flash process, where a diluent is added to bitumen to reduce the API gravity, a natural gas stripping process, where natural gas may be added to bitumen to reduce the API, a flash treatment of the oil sands using heat, where water may be found on top of the oil, a freezing process, and/or a solvent or chemical wash where different solvents may be used to wash bitumen from the sand. That is, advantageously, because of the presently described mechanical excavation of oil sands, bitumen may be separated from the extracted oil sands using any means known in the art.

EXAMPLE

Figure 8A:
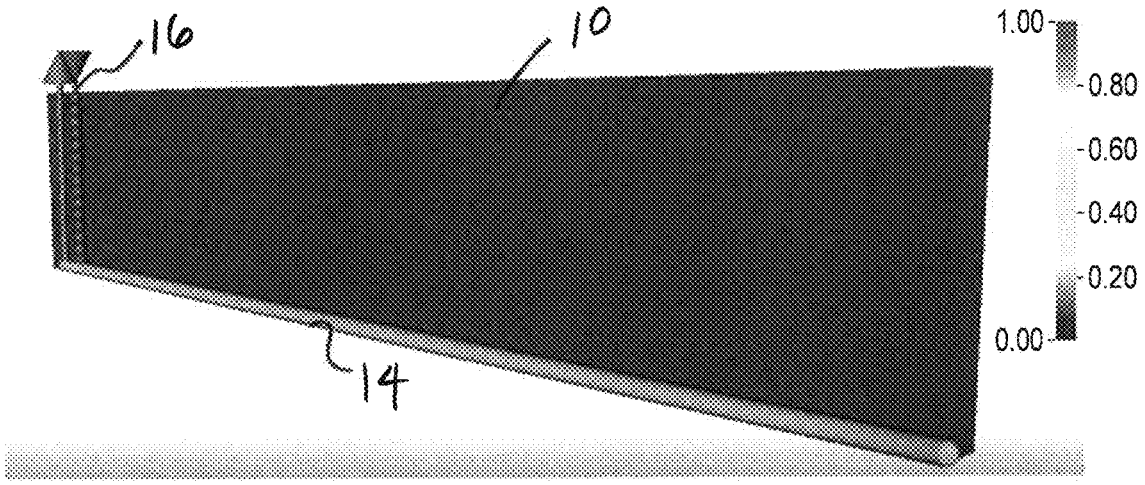
FIGS. 8A-8D are modeled schematics showing the progression of hydrocarbon production upon operation of first and second phases of the present apparatus and methodologies, according to embodiments, FIGS. 8A-8D collectively referred to herein as FIG. 8.
Figure 8B:
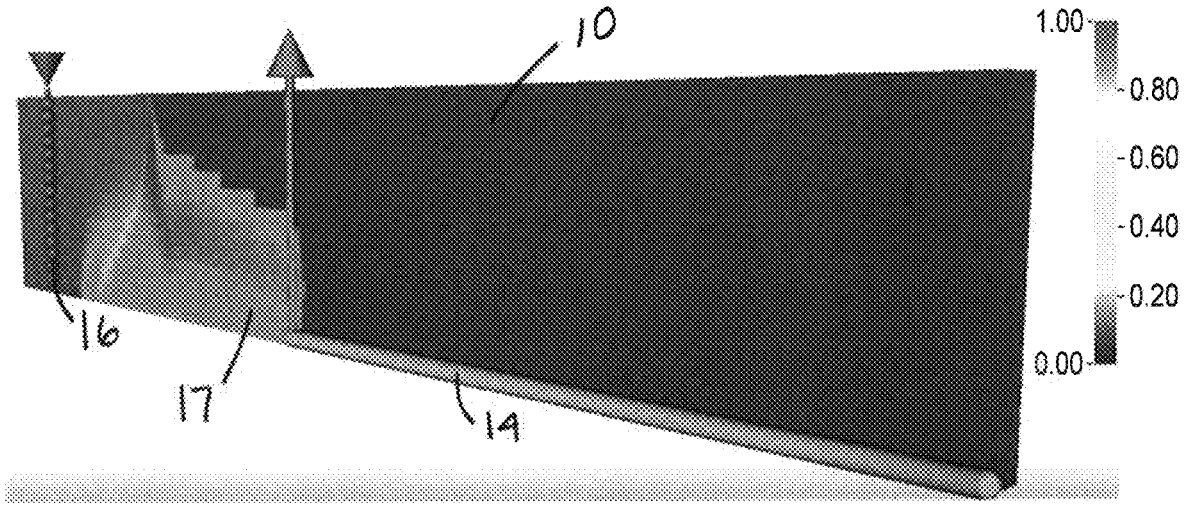
Figure 8C:
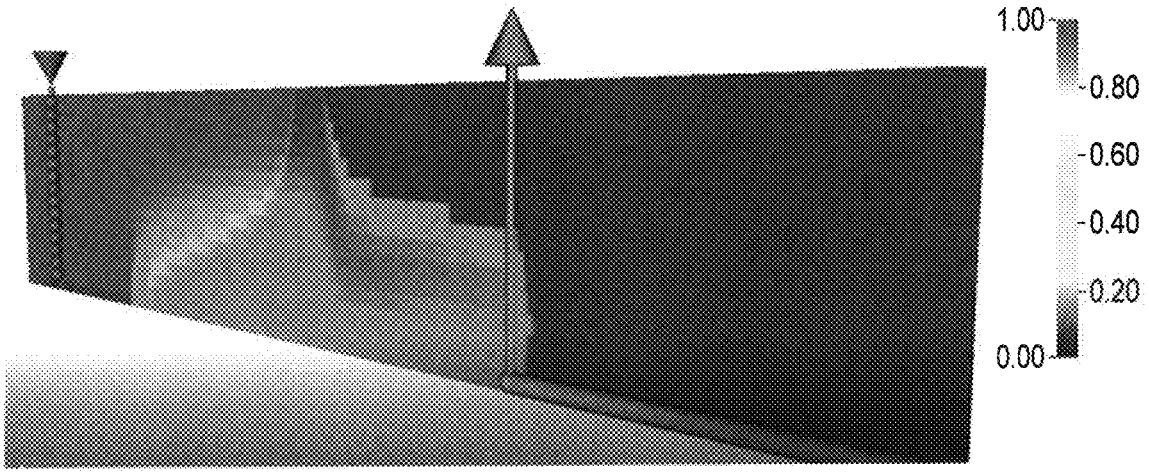
Figure 8D:
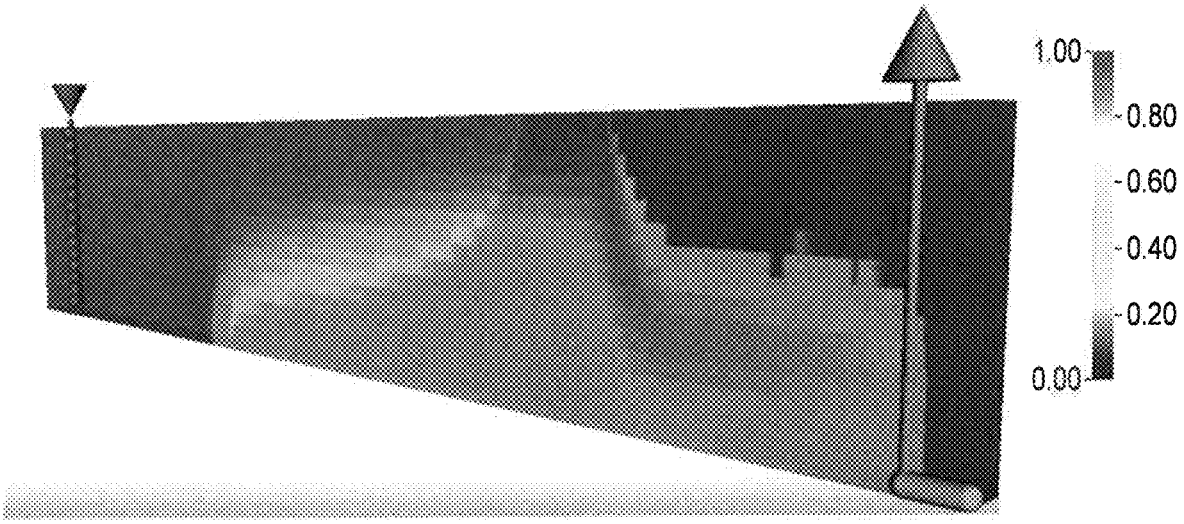
Figure 9:
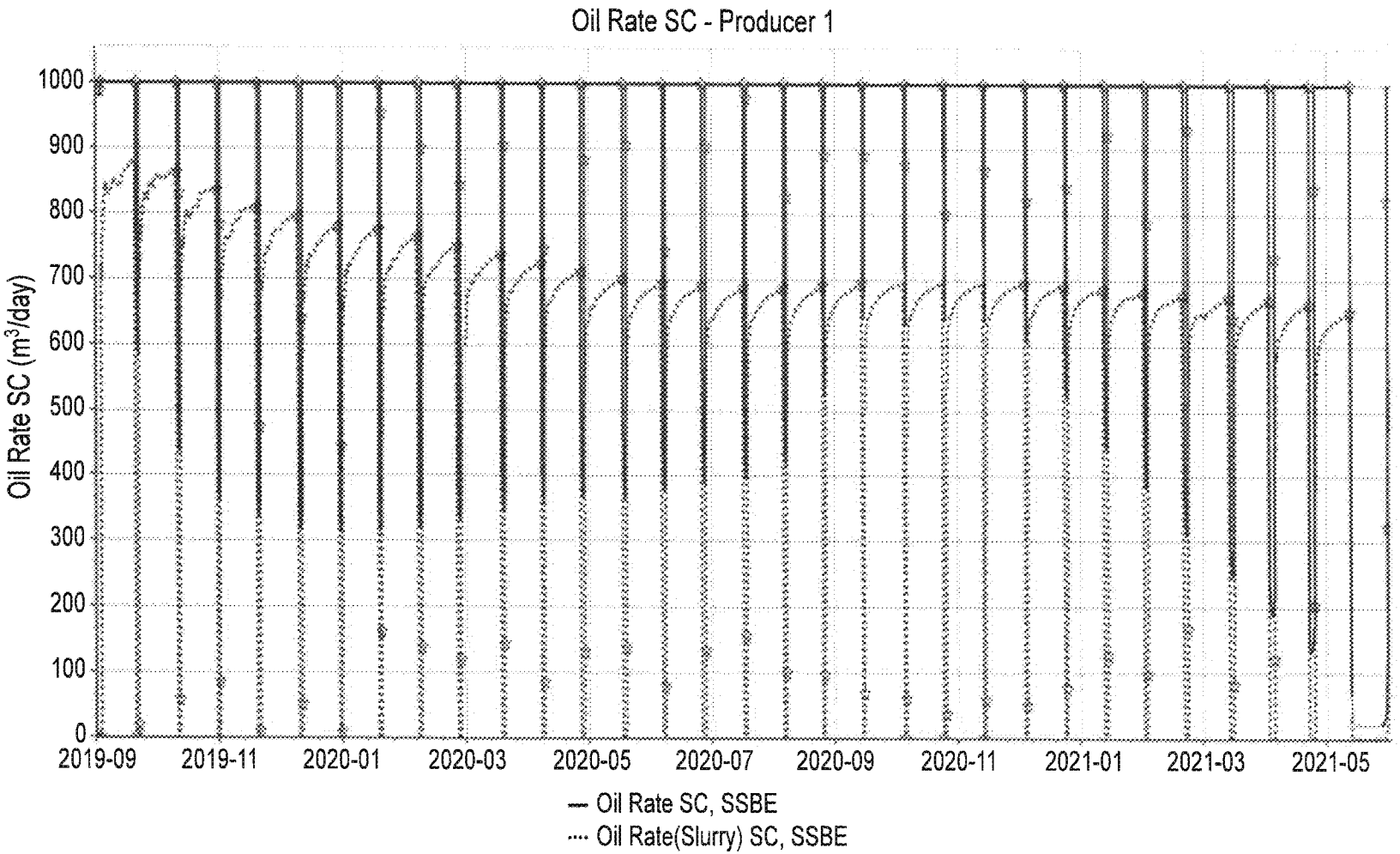
FIG. 9 is a graphical representation of the modeled schematics show in FIG. 8.

By way of example, the concept of the 'edge' is further schematically depicted in FIGS. 8 and 9, which show an example progression of the oil sands production, over time (e.g., over a one-year period), according to the present apparatus and methodologies. FIG. 8 schematically depicts an oil sands deposit pre-production, the at least one production well 14 shown positioned at or near the bottom of the deposit 10.

As the first phase begins to conclude, and production of the oil sands via gravity slows, the second pressurized fluid-assisted phase of production may commence. During the second phase, pressurized fluids such as tailings slurry may be injected into the oil sands deposit via the at least one injection well 16. The pressurized fluids may comprise tailings slurry or other suitable solidifying materials as known in the art, and may serve to assist in supporting the gravity-driven collapse of the bituminous sands towards the target area 17 at or towards the least one production well 14. Advantageously, the injected fluids need not meet any fill or paste properties commonly required in the art, including backfill tailings used in hydraulic mining processes. It is contemplated that the injection of pressurized fluids may also commence at the same time as the first phase, or at some time during the first phase, and that any description as to the timing of the injection commences is not intended to be limiting.

With slowing of bituminous sands being produced by gravity and the injection of pressurized fluids into the deposit 10, the fluids being produced may begin to contain a portion of the injected fluids, i.e., production fluids may begin to comprise a tailings cut. At such a time, according to embodiments, the production operations may be ceased and the at least one production well 14 may be re-positioned (i.e., pulled back) away from the at least one injection well 16 (FIG. 8B), away from the current target area 17, and deeper into the oil sands formation 10. It is contemplated that the at least one production well 16 may be repositioned for maximal production of bituminous sands (and to reduce the tailings cut). As shown through the progression of FIGS. 8B-8D, the at least one production well 14 has been withdrawn from its initial position in FIG. 8A and re-positioned so as to maximize to access to the oil sands being produced from the formation 10 and to minimize the inadvertent contamination with injected fluids from the injection area 19. Once re-positioned, production operations may be commenced again. FIGS. 8B-8D show the further progression of the at least one production well 14 being pulled back over time.

It is an object of the present apparatus and methodologies that the injection of pressurized fluids via the at least one injection well 16 does not occur such that the fluids are injected into or near the production zone 17 directly, but rather such that the fluids are injected in order to maintain sufficient downhole pressures/temperatures etc. for continued oil sands production, and in order to assist mobilization of the bituminous sands from the towards the production zone 17.

Over time, the tailings cut of the production fluids, i.e., the ratio oil sands to tailings slurry being produced, may be closely monitored and controlled. Where the quantity of injected tailings slurry increases in the production fluids, operations may again be ceased and the at least one production well 16 may be pulled back further, drawing oil sands towards the production well 16 and creating a larger production zone between the edge of injected fluids and oil sands being produced. Controlled injection of pressurized fluids and defined repositioning of the at least one oscillating mechanical excavator enables the tuned production of oil sands content. In combination, according to embodiments herein, the present apparatus and methodologies serve to maximize production of the bituminous sands and to minimize production of injected fluids.

Having regard to FIG. 9, a graphical representation of the models shown in FIGS. 8A-8D is provided. Production of the bituminous sand is shown over a one-year duration, with production being limited to 1000 $m^3$/d (solid lines). Downward spikes in the production profile (i.e., where spikes show a dip in production) represent a break in production where production is ceased for repositioning of the at least one production well. In other words, an observed break in production represents the time operations of the present apparatus and methodologies may be ceased and the at least one production well is pulled back in order to maximize bituminous sands production.

Correspondingly, an increase in tailings cut (dotted lines) signals the time when operations of the present apparatus and methodologies should be ceased such that the at least one production well can be pulled back in order to minimize tailings slurry production. For demonstration purposes, production of the injected tailings (dotted lines) was not limited in order to better understand and quantify the amount of injected tailings slurry that would be produced from the production well with the pullback described above. The tailings sand production rates are approximately 70-80% of the limited bituminous sand production and thus pull back rates may require further tuning in order to maximize bituminous sand production and to reduce the production of tailings sand.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and the described portions thereof.

What is claimed is:

1. A method of recovering hydrocarbons from a target area within a subterranean formation, the method comprising:

providing at least one production well in the formation at or near the target area;

providing at least one mechanical excavator rotatably disposed within the production well, the mechanical excavator having a first input end and a second discharge end;

permitting the hydrocarbons at the target area to be received within the first input end of the mechanical excavator; and rotating the at least one mechanical excavator to convey the recovered hydrocarbons received within the first input end of the mechanical excavator from the first input end to the second discharge end for recovery;

wherein, as the hydrocarbons being recovered at the target area are depleted, the method further comprises withdrawing the at least one mechanical excavator away from the target area for permitting additional hydrocarbons to be received within the first input end of the mechanical excavator.

2. The method of claim 1, wherein the method may further comprise providing at least one injection well for injecting pressurized fluids into an injection area in the formation.

3. The method of claim 2, wherein the at least one injection well is positioned for the injection area to be offset from the target area.

4. The method of claim 2, wherein the at least one injection well is positioned at a sufficient distance from the at least one production well to form a formation barrier therebetween.

5. The method of claim 2, wherein the at least one injection well is positioned at a sufficient distance from the at least one production well to form at least one formation pillar therebetween.

6. The method of claim 5, wherein, as the hydrocarbons being recovered at the target area are depleted, the target area forms at least one void adjacent the at least one pillar.

7. The method of claim 6, wherein the method may further comprise injecting the pressurized fluids via the at least one injection well into the at least one void.

8. The method of claim 2, wherein the injection of the pressurized fluids may be continuous or intermittent with the recovery of hydrocarbons.

9. The method of claim 1, wherein the target area is at a depth between 50 meters and 200 meters below the surface.

10. The method of claim 1, wherein the recovery of the hydrocarbons by the mechanical excavator is gravity-driven.

11. The method of claim 1, wherein the at least one mechanical excavator comprises at least one auger conveyor.

12. The method of claim 11, wherein the at least one auger conveyor may comprise a plurality of augers operably connected end to end to receive the recovered hydrocarbons from the target area and to convey the recovered hydrocarbons to the surface.

13. The method of claim 1, wherein the method further comprises transporting the recovered hydrocarbons to at least one hydrocarbon processing facility.

14. The method of claim 1, wherein the hydrocarbons are oil sands.

15. A method of mining hydrocarbons from a target area within a subterranean formation, the method comprising a first phase of:

providing at least one production well in the formation at or near the target area;

providing at least one mechanical excavator rotatably disposed within the production well, the mechanical excavator having a first input end and a second discharge end;

permitting the hydrocarbons at the target area to be received within the first input end of the mechanical excavator; and rotating the at least one mechanical excavator to convey the mined hydrocarbons received within the first input end of the mechanical excavator from the first input end to the second discharge end;

wherein, as the hydrocarbons being mined from the target area are depleted, the method further comprises:

withdrawing the at least one mechanical excavator away from the target area for permitting additional hydrocarbons to be mined within the first input end of the mechanical excavator.

16. The method of claim 15, wherein the method further comprises providing at least one injection well for injecting pressurized fluids into an injection area in the formation.

17. The method of claim 16, wherein the at least one injection well is positioned for the injection area to be offset from the target area.

18. The method of claim 16, wherein the at least one injection well is positioned at a sufficient distance from the at least one production well to form a formation barrier therebetween.

19. The method of claim 15, wherein the method further comprises transporting the recovered hydrocarbons to at least one hydrocarbon processing facility.

* * * * *